US007215348B2

(12) United States Patent
Nomura et al.

(10) Patent No.: US 7,215,348 B2
(45) Date of Patent: May 8, 2007

(54) IMAGE FORMATION DEVICE AND IMAGE FORMATION METHOD

(75) Inventors: Yujiro Nomura, Nagano-Ken (JP); Mitsukazu Kurose, Nagano-Ken (JP); Kiyoshi Tsujino, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 207 days.

(21) Appl. No.: 10/496,496

(22) PCT Filed: May 28, 2003

(86) PCT No.: PCT/JP03/06655

§ 371 (c)(1),
(2), (4) Date: May 21, 2004

(87) PCT Pub. No.: WO03/101743

PCT Pub. Date: Dec. 11, 2003

(65) Prior Publication Data

US 2005/0068355 A1 Mar. 31, 2005

(30) Foreign Application Priority Data

May 31, 2002 (JP) ..... 2002-158865
May 1, 2003 (JP) ..... 2003-126213
May 1, 2003 (JP) ..... 2003-126214

(51) Int. Cl.
*B41J 2/45* (2006.01)

(52) U.S. Cl. ..... 347/132; 347/237

(58) Field of Classification Search ..... 347/130, 347/131, 132, 237, 247
See application file for complete search history.

(56) References Cited

U.S. PATENT DOCUMENTS 5,245,355 A * 9/1993 Morton ..... 347/118
5,831,657 A 11/1998 Sakaue et al.
5,978,403 A 11/1999 Iwasa et al.

FOREIGN PATENT DOCUMENTS

| | | | |
|---|---|---|---|
| JP | 61-182966 | A | 8/1986 |
| JP | 64-26468 | A | 1/1989 |
| JP | 3-55271 | A | 3/1991 |
| JP | 6-198958 | | 7/1994 |
| JP | 6-278322 | A | 10/1994 |
| JP | 7-137339 | | 5/1995 |
| JP | 10-73980 | A | 3/1998 |
| JP | 10-107386 | | 4/1998 |
| JP | 10-278339 | | 10/1998 |
| JP | 11-105344 | A | 4/1999 |
| JP | 11-109891 | A | 4/1999 |
| JP | 11-129541 | A | 5/1999 |
| JP | 2000-260411 | A | 9/2000 |

* cited by examiner

*Primary Examiner*—Huan Tran
(74) *Attorney, Agent, or Firm*—Sughrue Mion, PLLC

(57) ABSTRACT

Image data are inputted from a data processing means (23) into storage means (24) so that light emitting elements on one line (28*a*) of a light emitting element (yellow) line head (28) are actuated according to signal outputted from a shift resistor (24*a*) so as to expose pixels on an image carrier. At a point of time when the pixels reach a position corresponding to the light emitting elements in a next line (28*b*) by moving the image carrier in a direction of arrow X, the image data are transmitted to a shift resistor (24*b*) and then outputted to the line (28*b*) so as to expose the pixels again. The image data are transmitted among the shift resistors sequentially by moving the image carrier, thereby achieving the multiple exposure of the same pixels.

10 Claims, 28 Drawing Sheets

FIG. 7
| BIT DATA NO. | BIT DATA | GRADATION DATA |
|---|---|---|
| 1 | 0 0 0 0 0 0 0 0 | 0 |
| 2 | 0 0 0 0 0 1 0 0 | 4 |
| 3 | 0 0 0 0 1 0 0 0 | 8 |
| 4 | 0 0 0 1 0 0 0 0 | 16 |
| 5 | 0 0 1 0 0 0 0 0 | 32 |
| 6 | 0 1 0 0 0 0 0 0 | 64 |
| 7 | 1 0 0 0 0 0 0 0 | 128 |
| 8 | 1 1 1 1 1 1 1 1 | 255 |
FIG. 9(a)
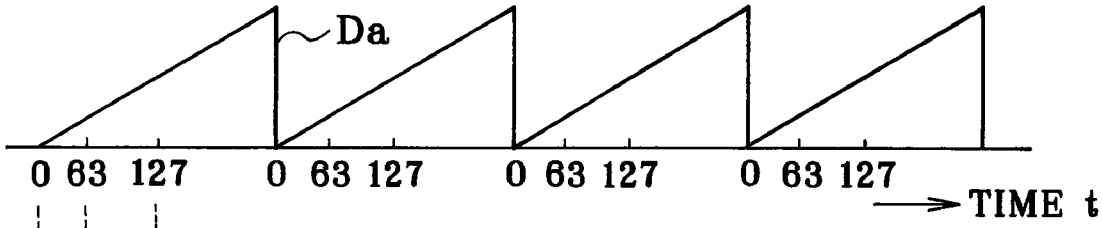
FIG. 9(b)
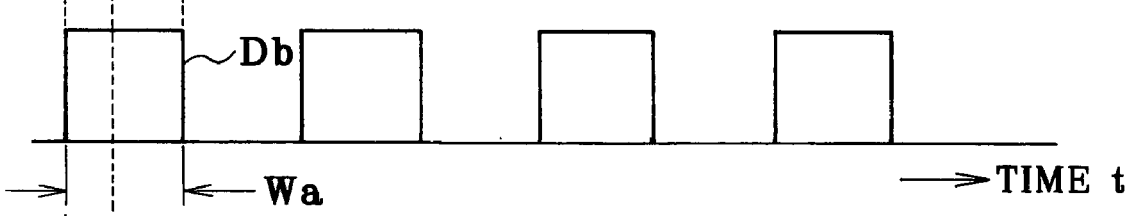
FIG. 9(c)
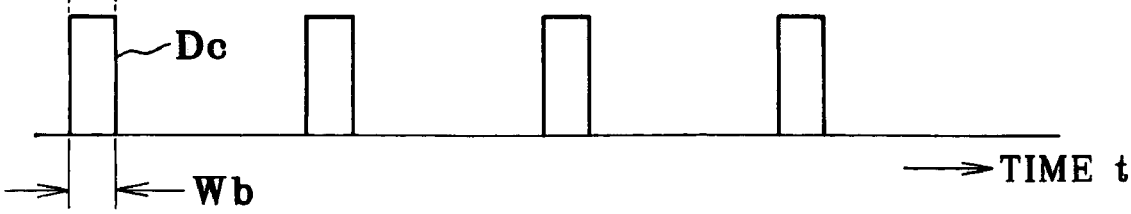

IMAGE FORMATION DEVICE AND IMAGE FORMATION METHOD

TECHNICAL FIELD

The present invention relates to an image forming apparatus and an image forming method which are directed to simplify the circuit structure and to speed up the light emitting control during exposure of pixels on an image carrier in multiple exposure manner capable of outputting gradation.

Background Art

In conventional image forming apparatus in which a latent image is written on an image carrier, it is known to employ an LED (light emitting diode) array as writing means. In case of employing light emitting elements such as an LED, it is necessary to pay attention to the relation between the luminance (amount of light) and the life duration of each light emitting element. That is, the life duration can be increased by reducing the luminance of the light emitting element. In this case, however, there is a problem that the amount of light for exposure is insufficient to form image. When the luminance of the light emitting element is increased, enough amount of light for exposure for forming image is obtained. In this case, however, there is a problem that the life duration is shortened.

For this, the development of material for obtaining light emitting elements capable of providing large luminance and having long life duration has been encouraged. However, in the present state of affairs, it is too expensive to achieve the practical use. In this connection, a line head (optical head) of multiple exposure type in which each pixel is exposed by a plurality of light emitting elements has been developed. As an example (1) of such line heads of multiple exposure type, Japanese Patent Unexamined Publication No. S61-182966 discloses a recording array head on which light recording elements are aligned in a plurality of rows in the rotational direction of a photoreceptor drum. An image data is overlappingly recorded at the same pixel by shifting the light emitting recording elements in the direction of the rows with moving the photoreceptor drum. The example (1) has an advantage that higher speed image formation is achieved even using light recording elements with low light-emitting output.

Another example (2) is disclosed in Japanese Patent Unexamined Publication No. S64-26468 in which an EL element panel is composed of EL element group of 20 dots×640 dots (vertical×horizontal). The EL element group is driven at a speed same as the moving speed of a photoreceptor for every line. Accordingly, the amount of light irradiated on a single pixel is twentyfold the amount of light emitted from each EL element. This example also can cope with high speed of image formation because the amount of light of exposure per pixel is increased.

Another example (3) is disclosed in Japanese Patent Unexamined Publication No. H11-129541 and is a print head on which LEDs are aligned in a plurality of lines such that multiple exposure is made on each pixel by moving the print head in the main scanning direction. In this example, since the multiple exposure is conducted, variations in amount of light among the respective LEDs can be equalized, thereby improving the image quality. Still another example (4) is disclosed in Japanese Patent Unexamined Publication No. 2000-260411 and is an optical printer head on which plural lines of LED array chips are aligned. The gradation of each pixel can be changed among three levels by turning ON or OFF the LED array chips on each line.

The aforementioned examples (1) and (2) relate to a technology of monochrome image formation and therefore have a problem that gradation control for neutral density is impossible. The example (3) relates to a technology of a serial type in which the line head is driven and therefore has a problem of having a complex driving mechanism. The example (4) relates to a technology in which the LED array chips on each line are turned ON and OFF and therefore has a problem of complexity of the control circuit.

Since the number of light emitting elements in the line head of multiple exposure type are greater than that of a line head of normal exposure type and it is necessary to control the light emitting elements synchronously with the movement of the photoreceptor, there is a problem of complexity of the control circuit for conducting the data processing and it is therefore difficult to achieve higher speed light emitting control. Especially, in case that a line head (optical head) of multi-exposure type is employed for color image formation, the amount of data to be processed must be severalfold that in the case of ON-OFF control because the gradation control for each pixel is sometimes required. This makes the speeding up of emission control further difficult. In case of line head of multiple exposure type, it is required to send a large amount of data processed by a data processing unit to the line head, thus increasing the number of wires between the line head and the body of an image forming apparatus. Accordingly, it is necessary to employ an interface capable of supporting the high-speed processing, thus increasing the cost.

The present invention was made in view of the aforementioned problems of conventional techniques and the object of the present invention is to provide an image forming apparatus and an image forming method which are directed to simplify the circuit structure and to speed up the light emitting control during the exposure of pixels on an image carrier in multiple exposure manner capable of outputting gradation.

DISCLOSURE OF THE INVENTION

A first image forming apparatus of the present invention achieving the aforementioned object is an image forming apparatus in which a plurality of lines each having a plurality of light emitting elements are arranged to have rows in a sub scanning direction of an image carrier so that light emitting elements are arranged in a matrix in a plane, wherein pixels on said image carrier are exposed by the light emitting elements aligned in one line and exposed again by the light emitting elements aligned in the next line after the movement of said image carrier, and in the same manner, said pixels are sequentially exposed by the light emitting elements on another line after the movement of said image carrier so as to achieve multiple exposure of the pixels. The first image forming apparatus is characterized by comprising control means by which said light emitting elements on respective lines for exposing same pixels are driven by a TFT so as to emit a same amount of light, so that the pixels can be exposed according to gradation output formed by said control means.

The first image forming apparatus of the present invention is characterized by comprising storage means for storing image data formed by said control means and outputting said image data to said light emitting elements, wherein said storage means is composed of multiple shift resistors which are arranged to correspond to the lines of the light emitting elements arranged in the sub scanning direction, respectively and are designed to transport image data, hold the image data, and output the image data to the light emitting elements, wherein the image data supplied to the shift resistor on the first line is transmitted in the main scanning direction and is also transmitted in the sub scanning direction to the shift resistor on a next line, and, in this manner, the image data is sequentially transmitted in the sub scanning direction to the shift resistors on the respective lines so that the image data is outputted to the light emitting elements on each of lines corresponding to the shift resistors, respectively. The first image forming apparatus is further characterized in that there are lines of pixels to be exposed and lines of pixels not to be exposed on said image carrier, the light emitting elements on the respective lines are arranged to correspond to the lines of pixels to be exposed, respectively, said storage means are arranged to correspond to both the lines of pixels to be exposed and the lines of pixels not to be exposed, respectively, and the storage means corresponding to the lines of pixels not to be exposed do not output said image data.

Furthermore, the first image forming apparatus of the present invention has the following characteristics with regard to said light emitting elements: (1) the interval in the sub scanning direction between spot positions formed on the image carrier by the light emitting elements is an integral multiple of the pixel pitch in the sub scanning direction; (2) the light emitting elements are controlled by a driving circuit according to the active matrix method; (3) the amounts of light of the light emitting elements are controlled in the PWM method; (4) the amounts of light of the light emitting elements are controlled in the intensity modulation method; and (5) each of the light emitting elements comprises an organic EL.

The first image forming apparatus of the present invention is still further characterized in that the image forming apparatus is of a tandem type which comprises at least two image forming stations each having an image carrier and further having a charging means, an exposure head, a developing means, and a transfer means which are arranged around said image carrier and forms a color image by passing a transfer medium through the respective stations.

In the first image forming apparatus of the present invention, once the control means forms data for the first one line, the operations of all of light emitting elements in the line head can be controlled by storing the image data for the first one line in the storage means (shift resistors) and just transmitting the image data among the storage means. Therefore, the control means is not required to produce data for all light emitting elements of the line head, thereby simplifying the structure of circuit and achieving the high-speed data processing.

In the first image forming apparatus of the present invention, the storage means for pixel lines and the light emitting element lines can be arranged to correspond to each other. In this case, the timing for transmitting image data stored in a storage means to the next storage means and the timing for making light emitting elements in the line to emit light on the basis on the image data for a pixel line stored in the storage means can be synchronized, thereby simplifying the circuit structure and speeding up the operation of the light emitting element lines.

Further, in the first image forming apparatus of the present invention, the light emitting elements are controlled according to the active matrix method. Accordingly, the light emitting elements can be maintained to keep emitting light by means of condensers and transistors arranged around the light emitting elements. Therefore, the light emitting elements remain to emit light even during the transmission of image data from a storage means to the next storage means, thereby exposing pixels with high luminance.

In addition, in the first image forming apparatus of the present invention, the amount of light emitted from the light emitting elements is controlled in the PWM method. Since the amount of exposure can be changed by ON/OFF control of the light emitting elements, the circuit structure can be simplified. Moreover, in the first image forming apparatus of the present invention, the amount of light emitted from the light emitting elements is changed in the intensify modulation method. Therefore, it is not required to control the ON/OFF of the light emitting elements at a high speed. Even when the speed of response of the light emitting elements is slow, the amount of exposure can be changed at a high speed. In addition, in the first image forming apparatus of the present invention, the light emitting elements can be easily formed on a glass substrate, thereby achieving lower price.

A first image forming method of the present invention achieving the aforementioned object is an image forming method using a plurality of lines each of which has a plurality of light emitting elements to be controlled by a TFT and which are arranged to have rows in the sub scanning direction of an image carrier and using multiple shift resistors which are adapted to transport image data formed by control means, hold the image data, and output the image data to the light emitting elements, which are arranged to correspond to the lines of the light emitting elements, respectively. The first image forming method is characterized by comprising supplying image data to the shift resistor on a first row and transmitting the image data in the main scanning direction, actuating the light emitting elements on a first line to expose pixels on the image carrier to light according to the image data outputted from the shift resistor of the first line, moving the image carrier for a pixel pitch, transmitting the image data from the shift resistor on the first row to the shift resistor on the next row in the sub scanning direction synchronously with the movement of the image carrier in timing, actuating the light emitting elements on a next line to emit a same amount of light as that of the light emitting elements on the former line to repeatedly expose said pixels, and sequentially transmitting the image data in the sub scanning direction at the shift resistor for the respective lines with moving of the image carrier for the pixel pitch, so that said pixels are subjected to multiple exposure by the light emitting elements on the respective lines. The first image forming method is characterized by further comprising a step of actuating the light emitting elements according to the gradation output formed by said control means to expose the pixels.

A second image forming apparatus of the present invention achieving the aforementioned object is an image forming apparatus in which a plurality of lines each having a plurality of light emitting elements are arranged to have rows in the sub scanning direction of an image carrier so that light emitting elements are arranged in a matrix in a plane, wherein pixels on said image carrier are exposed by the light emitting elements aligned in one line and exposed again by the light emitting elements aligned in the next line after the movement of said image carrier, and in the same manner, said pixels are sequentially exposed by the light emitting elements on another line after the movement of said image carrier so as to achieve multiple exposure of the pixels. The second image forming apparatus is characterized by comprising storage means for storing information of misalignment of the mounted position of the line head relative to the apparatus, light emitting elements for adjusting the image position which are preliminarily arranged in respective lines of said line head, and control means for inserting blank data to the image data for every line of the light emitting elements corresponding to the misalignment so as to form image in normal position by correcting said misalignment of the mounted position of the line head according to the information of misalignment of the mounted position of the line head.

According to the second image forming apparatus, it is not required to mechanically correct the misalignment of image forming portions. That is, the misalignment in image formed by image forming portions can be corrected by controlling the positions where image data are written, thereby eliminating the mechanical adjustment. Therefore, the misalignment in image can be easily corrected in the line head for conducting multiple exposure.

A third image forming apparatus of the present invention achieving the aforementioned object is an image forming apparatus comprising line heads in which a plurality of light emitting elements are arranged in a matrix in a plane to form a plurality of unicolor images to be superposed on each other, storage means for storing information of misalignment of the mounted position of the line head relative to the apparatus, and control means for inserting blank data to the image data for every line of the light emitting elements corresponding to the misalignment so as to form image in normal position by correcting said misalignment of the mounted position of the line head according to said stored information of misalignment of the mounted position of the line head.

According to the third image forming apparatus of the present invention, even when the mounted position of one of line heads is shifted from the normal position in an image forming apparatus for forming a color image, the misalignment in image can be easily corrected without moving the position of the line head.

Further, the third image forming apparatus is characterized in that the image forming apparatus is of a tandem type which comprises at least two image forming stations each having an image carrier and further having a charging means, an exposure head, a developing means, and a transfer means which are arranged around said image carrier and forms a color image by passing a transfer medium through the respective stations. According to the third image forming apparatus of the present invention, in an image forming apparatus of a tandem type, the misalignment in image can be easily corrected.

A second image forming method of the present invention achieving the aforementioned object is an image forming method using a plurality of lines each of which has a plurality of light emitting elements and which are arranged to have rows in the sub scanning direction of an image carrier and using storage means, designed to transport image data formed by control means, hold the image data, and output the image data to the light emitting elements, which are arranged to correspond to the lines of the light emitting elements, respectively. The second image forming method is characterized by comprising a step of preliminarily arranging light emitting elements for adjusting the image position respective lines of said line head, a step of storing information of misalignment of the mounted position of the line head relative to the apparatus, a step of inserting blank data to the image data for every line of the light emitting elements corresponding to the misalignment so as to form image in normal position by correcting said misalignment of the mounted position of the line head according to said stored information of misalignment of the mounted position of the line head, a step of actuating the light emitting elements on the first line to expose pixels on the image carrier according to the image data outputted from the storage means, a step of moving the image carrier for a pixel pitch, a step of transmitting the image data to the storage means for the next line synchronously with the movement of the image carrier in timing, and a step of actuating the light emitting elements on the next line to emit the same amount of light as that of the light emitting elements on the former line to repeatedly expose said pixels. Further, the second image forming method is characterized by further comprising a step of actuating the light emitting elements according to the gradation output formed by said control means to expose the pixels.

A fourth image forming apparatus of the present invention achieving the aforementioned object is an image forming apparatus comprising a line head in which a plurality of lines each having a plurality of light emitting elements aligned in the main scanning direction are arranged to have rows in the sub scanning direction of an image carrier so that light emitting elements are arranged in a matrix in a plane, wherein pixels on said image carrier are exposed by the light emitting elements aligned in one line and exposed again by the light emitting elements aligned in the next line after the movement of said image carrier, and in the same manner, said pixels are sequentially exposed by the light emitting elements on another line after the movement of said image carrier so as to achieve multiple exposure of the pixels. The fourth image forming apparatus is characterized by comprising storage means for storing information of tilt of the line head relative to the main scanning direction, image data supplying means for supplying image data to the respective light emitting elements, delaying means for delaying the timing of supplying image data from said image data supplying means to the light emitting elements, and control means for conducting delay control to the image data to be supplied from said delaying means to light emitting elements according to said information of tilt in such a manner that the position of image formation corresponding to pixels on the image carrier is corrected from the tilt of the line head.

The fourth image forming apparatus is characterized in that the image forming apparatus is of a tandem type which comprises at least two image forming stations each having an image carrier and further having a charging means, an exposure head, a developing means, and a transfer means which are arranged around said image carrier and forms a color image by passing a transfer medium through the respective stations.

The fourth image forming apparatus conducts the following delay control in order to correct the tilt of the line head: (1) the light emitting elements are divided into a plurality of blocks and the delay control is conducted to image data to be supplied to said light emitting elements for every block; (2) a plurality of said line heads are arranged to correspond to different colors, respectively, and the light emitting elements of the line head which is tilted is subjected to said delay control during multiple exposure in which the respective colors are superposed on each other; and (3) among said plurality of light emitting element lines, the first light emitting element line is controlled with a delay control signal for correcting the tilt of said line head and the light emitting element lines including and after the second light emitting element line are controlled with signals formed by adding signal corresponding to the timing shift from the former light emitting element line to the aforementioned delay control signal for the front light emitting element line.

The storage means in the fourth image forming apparatus of the present invention has the following characteristics: (1) the storage means is disposed in the apparatus body; (2) the storage means is disposed in a cartridge in which the line head is arranged; (3) the storage means is disposed in the line head.

The light emitting elements in the fourth image forming apparatus of the present invention have the following characteristics: (1) said light emitting elements are controlled by a driving circuit according to the active matrix method; (2) the amounts of light of said light emitting elements are controlled in the PWM method; (3) the amounts of light of said light emitting elements are controlled in the intensity modulation method; and (4) each of said light emitting elements comprises an organic EL.

In the fourth image forming apparatus of the present invention, if the line heads are installed to the apparatus such that one or more of the line heads is tilted relative to the main scanning direction, the misalignment in image is corrected by controlling the positions where the image data are written, thereby eliminating the mechanical adjustment. Therefore, the misalignment in image can be easily corrected in the line head for conducting multiple exposure.

Further, in the fourth image forming apparatus, since the delay control is conducted for every block, the circuit structure can be simplified as compared to the case in which the delay control is conducted for every light emitting element. Since the delay control is conducted during multiple exposure, in case of forming an image formed by superposing a plurality of colors, the fourth image forming apparatus can form the image without color registration error. Since the light emitting element are controlled with signals formed by adding signal corresponding to the timing shift between the light emitting element lines, the control for light emitting elements can be simplified as compared to the case in which delay timings are set for all of the light emitting element lines.

In the fourth image forming apparatus of the present invention, since storage means for storing information of tilt of line head relative to the main scanning direction is disposed in the apparatus body, even when the line head is out of order for any reason, the tilt information of the line head can be securely maintained. Since the storage means is disposed in the cartridge to which the line head is mounted, the storage means can be replaced with a new storage means storing information corresponding to the tilt of new line heads automatically at the same time as the replacement of the cartridge. Since the storage means is disposed in the line head, after the replacement of the line head, the control for light emitting elements can be conducted according to the tilt information of a new line head.

Further, in the fourth image forming apparatus of the present invention, since the light emitting elements are controlled by a driving circuit according to the active matrix method, the light emitting elements can be maintained to keep emitting light by means of condensers and transistors arranged around the light emitting elements. Therefore, the light emitting elements remain to emit light even during the transmission of image data from a shift resistor to the next shift resistor, thereby exposing pixels with high luminance. In addition, the fourth image forming apparatus of the present invention is characterized in that the amounts of light emitted from the light emitting elements re controlled in the PWM method. Since the amount of exposure can be changed by ON/OFF control of the light emitting elements, the circuit structure can be simplified. Moreover, the amounts of light emitted from the light emitting elements are controlled in the intensify modulation method. Therefore, it is not required to control the ON/OFF of the light emitting elements at a high speed. Even when the speed of response of the light emitting elements is slow, the amount of exposure can be changed at a high speed. In addition, each of the light emitting elements comprises an organic EL. Therefore, the light emitting elements can be easily formed on a glass substrate, thereby achieving lower price.

Further, the fourth image forming apparatus is adopted to an image forming apparatus of a tandem type which comprises at least two image forming stations each having an image carrier and further having a charging means, an exposure head, a developing means, and a transfer means which are arranged around said image carrier and forms a color image by passing a transfer medium through the respective stations. Accordingly, in the image forming apparatus of a tandem type, the misalignment in image can be easily corrected.

A fifth image forming apparatus of the present invention is an image forming apparatus comprising a line head in which a plurality of lines each having a plurality of light emitting elements aligned in the main scanning direction are arranged to have rows in the sub scanning direction of an image carrier so that light emitting elements are arranged in a matrix in a plane, wherein pixels on said image carrier are exposed by the light emitting elements aligned in one line and exposed again by the light emitting elements aligned in the next line after the movement of said image carrier, and in the same manner, said pixels are sequentially exposed by the light emitting elements on another line after the movement of said image carrier so as to achieve multiple exposure of the pixels.

The fifth image forming apparatus being characterized by comprising storage means for storing information of tilt of the line head relative to the main scanning direction, and control means for controlling light emitting elements which protrude from the normal exposure line, among light emitting elements aligned in the sub scanning direction of said line head, to emit smaller amount of light and controlling the image data to be supplied to light emitting elements in such a manner that the position of image formation corresponding to the pixels on the image carrier is corrected from the tilt of the line head.

In the fifth image forming apparatus of the present invention, since the control means for controlling light emitting elements which protrude from the normal exposure line to emit smaller amount of light and controlling the image data to be supplied to light emitting elements in such a manner that the position of image formation corresponding to the pixels on the image carrier is corrected from the tilt of the line head is provided, outlines of pixels which are adjacent to each other in the main scanning direction can be clearly formed, thus preventing the deterioration of printing quality.

A third image forming method of the present invention achieving the aforementioned object is an image forming method using a line head in which a plurality of light emitting element lines each having a plurality of light emitting elements aligned in the main scanning direction are arranged in a matrix in a plane to have rows in the sub scanning direction of an image carrier so that pixels on the image carrier are repeatedly exposed by light emitting elements on the respective lines to achieve the multiple exposure. The third image forming method is characterized by comprising a step of storing the information of tilt of said line head relative to the main scanning direction and a step of controlling the image data to be supplied to light emitting elements by delaying the supply timing in such a manner that the position of image formation corresponding to the pixels on the image carrier is corrected from the tilt of the line head.

According to the third image forming method of the present invention, even when the line heads are installed to the apparatus such that one of the line heads is tilted to the main scanning direction, an image can be formed by multiple exposure without need of mechanical adjustment of the line head and with the printing quality prevented from deteriorating.

A fourth image forming method is an image forming method using a line head in which a plurality of light emitting element lines each having a plurality of light emitting elements aligned in the main scanning direction are arranged in a matrix in a plane to have rows in the sub scanning direction of an image carrier so that pixels on the image carrier are repeatedly exposed by light emitting elements on the respective lines to achieve the multiple exposure. The fourth image forming method is characterized by comprising a step of storing the information of tilt of said line head relative to the main scanning direction and a step of controlling light emitting elements which protrude from the normal exposure line to emit smaller amount of light, wherein the image data supplied to light emitting elements are controlled such that the position of image formation corresponding to the pixels on the image carrier is corrected from the tilt of the line head.

According to the fourth image forming method of the present invention, occurrence of misalignment in image due to the tilt of the line head can be prevented with simple control.

BRIEF DESCRIPTION OF THE DRAWINGS

FIG. 7 is a table for explanation of an example of the relation between bit data and gradation data;

FIGS. 9(*a*)–9(*c*) are characteristic graphs of an example in which the light emitting elements are controlled by the PWM method;

BEST MODE FOR CARRYING OUT THE INVENTION

The present invention will be described in the below with reference to the drawings.

Figure 2:
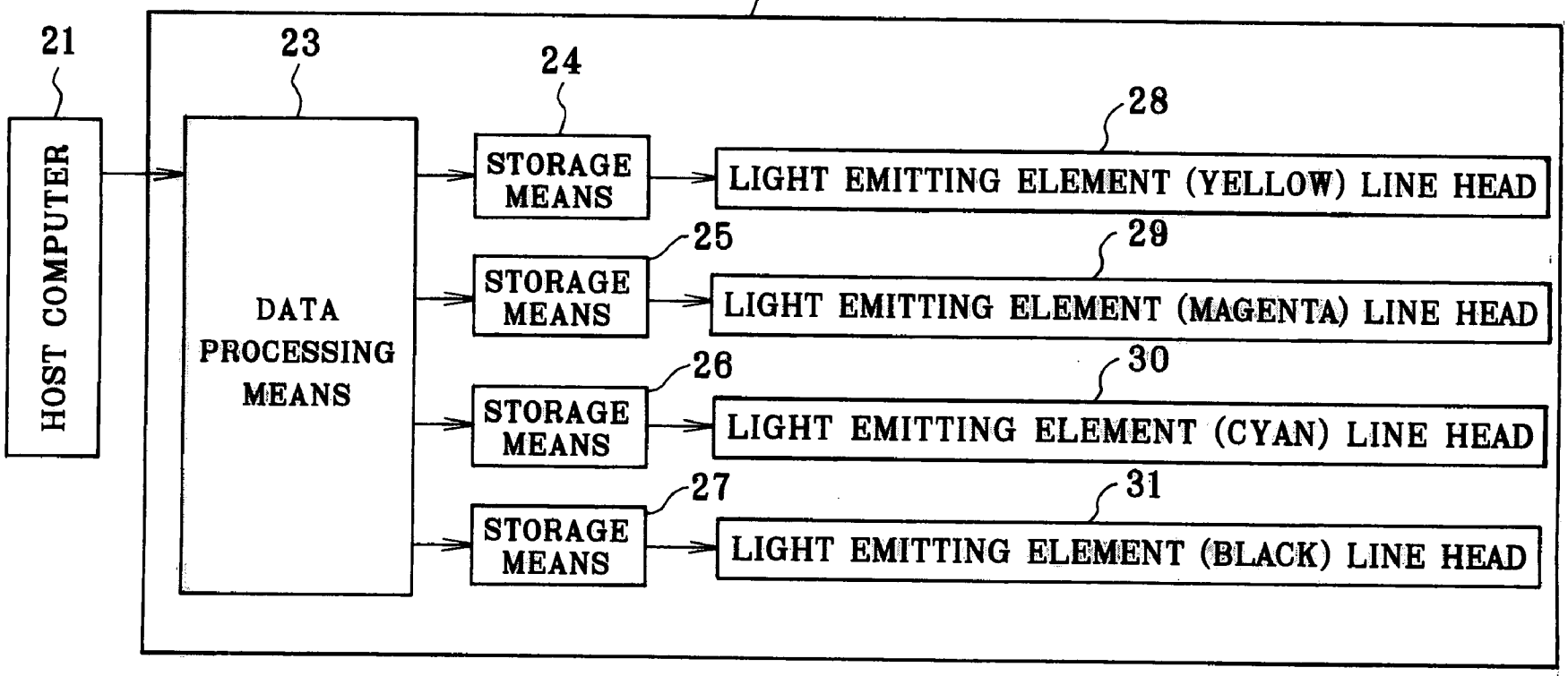
FIG. 2 is a block diagram showing the entire structure of the example shown in FIG. 1.

FIG. 2 is a block diagram showing the schematic structure of an image forming apparatus of the present invention. In FIG. 2, a host computer 21 produces printing data and sends the printing data to a control unit 22 of the image forming apparatus. The control unit 22 of the image forming apparatus comprises a data processing means 23, storage means 24–27, and light-emitting element line heads (optical heads) 28–31 arranged corresponding to the aforementioned storage means 24–27. The light-emitting element line heads 28–31 correspond to four colors, i.e. yellow, magenta, cyan, and black, respectively, to form a color image on a photoreceptor. The storage means 24–27 store image data corresponding to light-emitting element line heads 28–31 for the respective colors.

The data processing means 23 carries out processes such as color separation, gradation treatment, bit-mapping of image data, and correction of color registration error. The data processing means 23 outputs image data for each line to each storage means 24–27. Each light-emitting element line head 28–31 has a plurality of light emitting element lines arranged therein and is structured to conduct multiple exposure in which light emitting elements on the respective lines emit light to a same pixel. Therefore, each storage means 24–27 outputs image data for plural lines to each light-emitting element line head 28–31.

Figure 1:
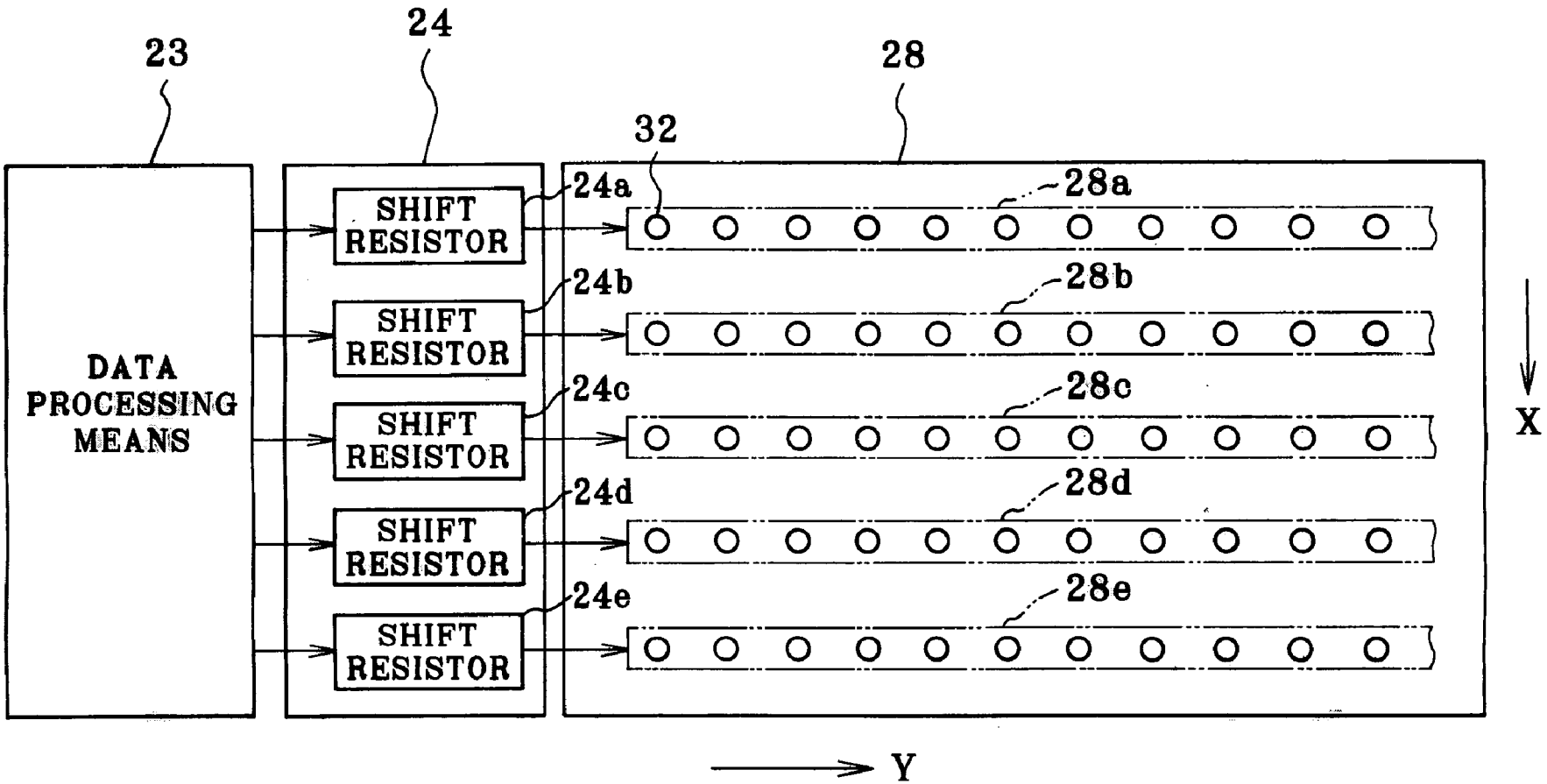
FIG. 1 is a block diagram partially showing an example of an image forming apparatus according to the present invention.

FIG. 1 is a block diagram partially showing the structure shown in FIG. 2. FIG. 1 shows details of the light-emitting element (yellow) line head 28 and the storage means 24 corresponding to the line head 28. In the example shown in FIG. 1, the line head 28 has a line 28*a* provided with a plurality of light-emitting elements 32. In this example, five lines 28*a*–28*e* are arranged in the sub scanning direction X of an image carrier and each line has the same number of light-emitting elements. The storage means 24 comprise shift resistors 24*a*–24*e* to correspond to the lines 28*a*–28*e* composed of the light-emitting elements, respectively. In FIG. 1, the direction of arrow X indicates the moving direction (sub scanning direction) of a photoreceptor drum (image carrier) and the direction of arrow Y indicates the main scanning direction.

Now, the operation of the block diagram shown in FIG. 1 will be described. As the image data is inputted from the data processing means 23 into the storage means 24, the shift resistor 24*a* outputs image data to the light emitting elements in the first line 28*a* so that the light emitting elements work, whereby pixels on the image carrier are exposed to a predetermined amount of light. The image carrier is driven to rotate in the direction of arrow X in such a manner that the pixels exposed by the light emitting elements of the first line 28*a* reach a position corresponding to the light emitting elements arranged in the next line 28*b*. At the same time, the image data inputted in the shift resistor 24*a* are transmitted to the shift resistor 24*b*.

The shift resistor 24*b* outputs the image data to the light emitting elements of the line 28*b* so that the light emitting elements work. Accordingly, the pixels previously exposed by the light emitting elements of the line 28*a* are exposed again by the light emitting elements of the line 28*b* with the equal amount of light. In this manner, the image data is sequentially transmitted from the previous shift resistor to the next shift resistor while the image carrier is moved in the direction of arrow X, whereby each same pixel is exposed again and again by light emitting elements in different lines. Consequently, in the example of FIG. 1, the respective pixels are exposed to light of which amount is quintuple of that of a single light emitting element, thereby quickly obtaining the amount of light required to expose each pixel. The number of the lines in which the light emitting elements are aligned in the sub scanning direction can be suitably selected, that is, the number for multiplying the amount of light for exposure to be obtained by a single light emitting element can be suitably selected, as necessary.

In case of gradation control for neutral density is conducted by the structure of FIG. 1, assuming that the predetermined luminance is 1, image data for luminance of 0.1 are inputted from the data processing device 23 to the shift resistor 24*a*. As mentioned above, by transmitting the image data sequentially to the shift resistors 24*a*–24*e* to output the image data to the light emitting elements while moving the image carrier, the luminance of each pixel becomes $0.1\times 5=0.5$, providing a neutral density. In this manner, output for gradation when exposing pixels can be obtained.

In the present invention, once the data processing means 23 of the image forming apparatus produces data only for the front one line, the image data for the first line is stored in the storage means (shift resistor) and are transmitted among the storage means, whereby the operations of all light emitting elements of the line head can be controlled. Since the data processing means is not required to produce data for all light emitting elements of the line head, the structure of circuit can be simplified and the data processing can be conducted at high speed.

Figure 3:
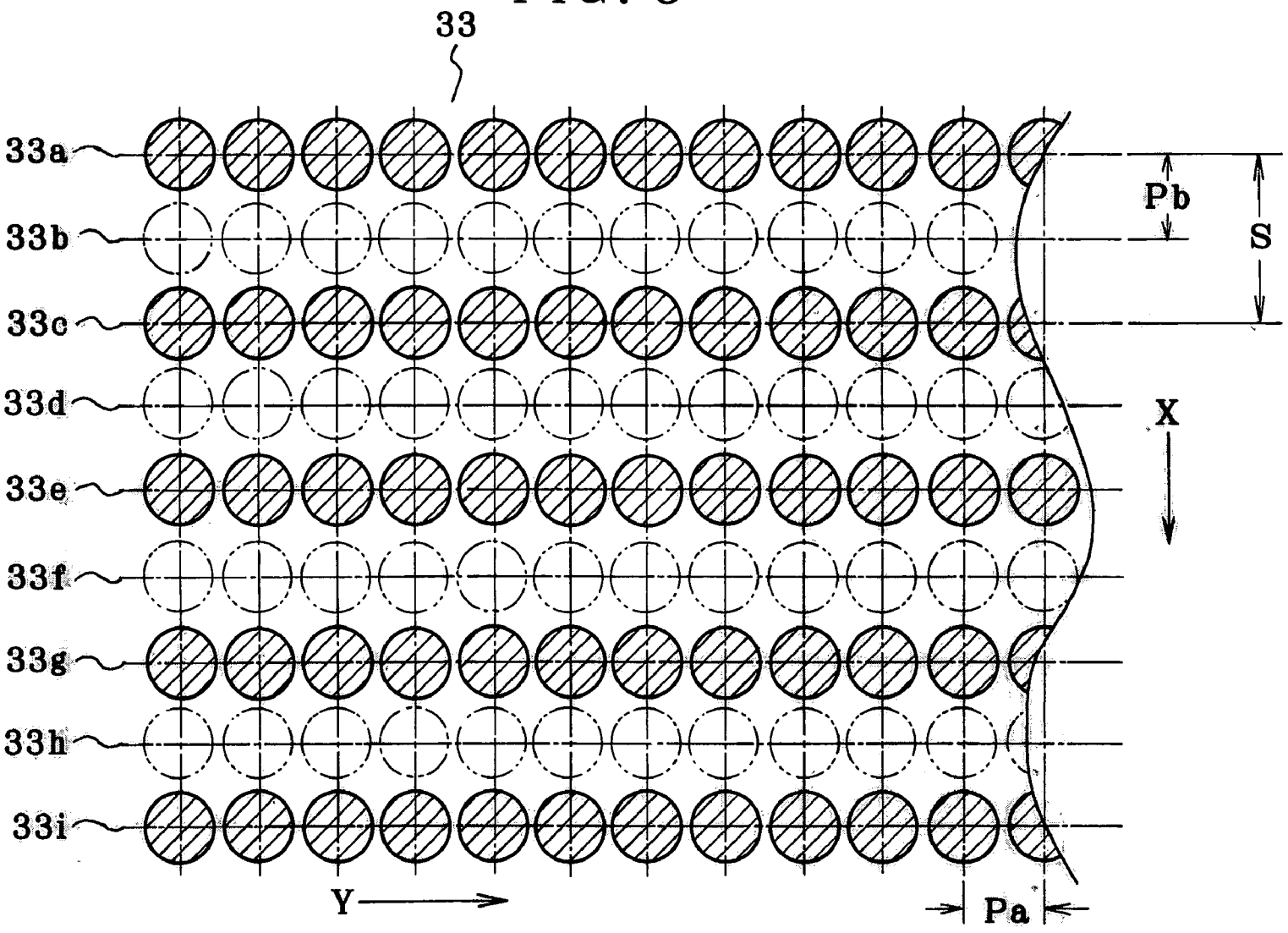
FIG. 3 is an explanatory illustration showing an example of an image forming apparatus according to another embodiment of the present invention.

FIG. 3 shows the structure according to another embodiment of the present invention and is an explanatory diagram of spot positions 33 to be formed on the image carrier. Hatched portions in FIG. 3 are spot positions. Pixels at these positions are exposed to light. Positions indicated by chain double-dashed lines are pixels not to be exposed to light. "Pa" indicates a pixel pitch in the main scanning direction and "Pb" indicates a pixel pitch in the sub scanning direction. "S" indicates a pitch between spot positions (spot position pitch) in the sub scanning direction which is an integer multiple of the pixel pitch. In this example, the pitch is twice as the pixel pitch. As for the spot positions 33 shown in FIG. 3, spots are formed in each of lines 33*a*, 33*c*, 33*e*, 33*g*, and 33*i* on the image carrier by light emitted from the light emitting elements, thereby exposing pixels. In each of lines 33*b*, 33*d*, 33*f*, and 33*h*, spots are not formed on the image carrier by light emitted from the light emitting elements.

Figure 4:
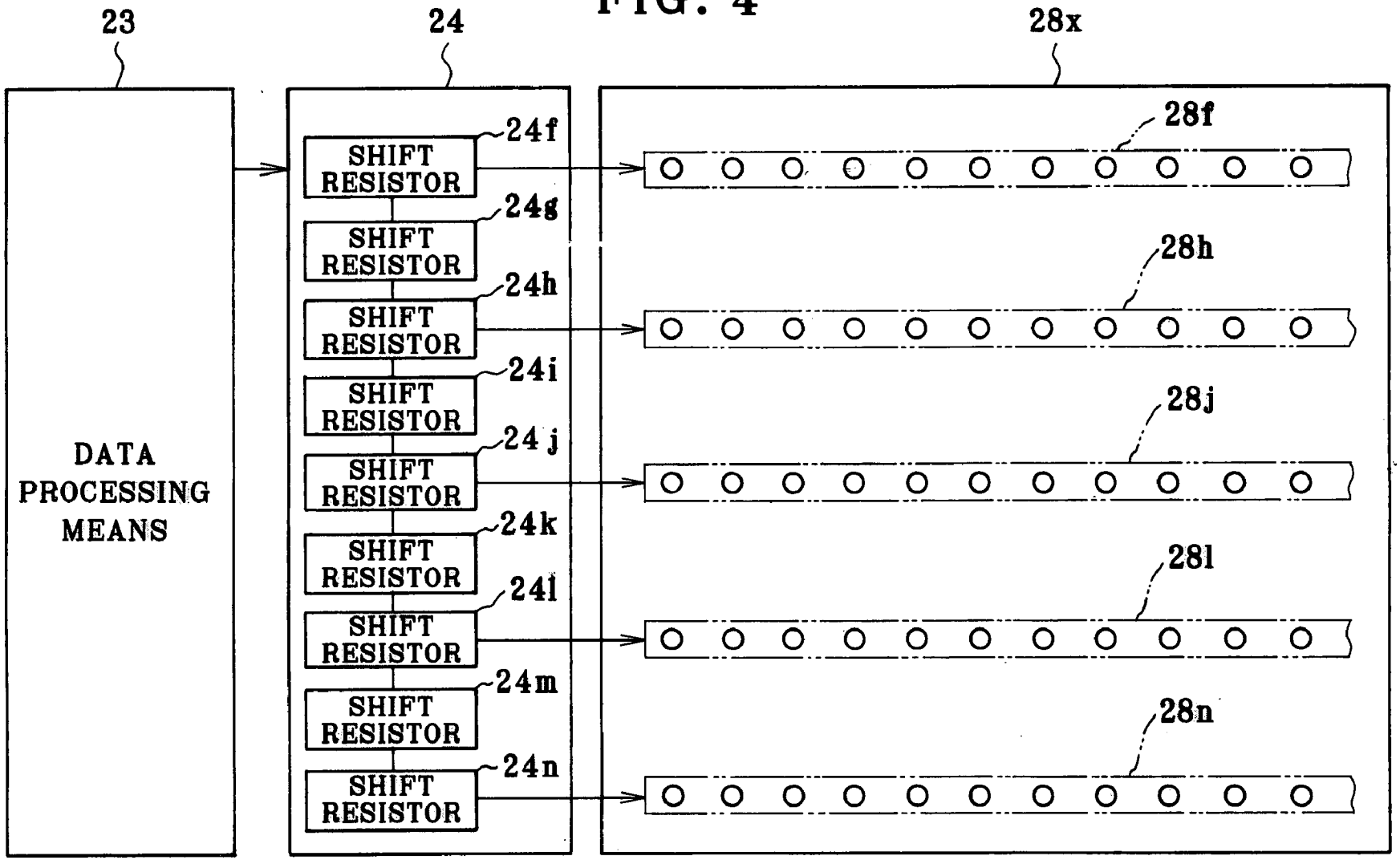
FIG. 4 is a block diagram showing a control unit of the image forming apparatus shown in FIG. 3.

FIG. 4 is a block diagram corresponding to FIG. 3. Description will be made as regard to the light-emitting element line heads 28X for yellow similarly to the description with respect to FIG. 1. The spot positions 33 shown in FIG. 3 are formed by lines 28*f*–28*n* on which light emitting elements are aligned. Positions where no lines of light emitting elements are formed in the line head 28X of FIG. 4 correspond to the positions where no pixels are exposed shown in FIG. 3. The storage means 24 comprises a first group consisting of shift resistors 24*f*–24*n* corresponding to the lines 28*f*–28*n* in which the light emitting elements are aligned, respectively. There is a second group consisting of shift resistors 24*g*–24*m* each of which is arranged between each pair of adjacent shift resistors among the aforementioned shift resistors 24*f*–24*n*. The shift resistors 24*g*–24*m* of the second group operate only for transmission of image data to the next shift resistor without outputting the image data to light emitting elements.

In the example of FIG. 3 and FIG. 4, the operation for exposing pixels at the spot positions 33*a* in lines on the image carrier will be described. The image data is outputted from the shift resistor 241*f* to the first line 28*f* of light emitting elements, whereby pixels on the image carrier are exposed. At the moment that the image carrier is driven to rotate just for the pixel pitch Pb in the sub scanning direction, the image data are transmitted from the shift resistor 24*f* to the shift resistor 24*g*. At this time, the shift resistor 24*g* does not output the image data so that no pixel is exposed. At the moment that the image carrier is further driven to rotate just for the pixel pitch in the sub scanning direction, the image data are transmitted from the shift resistor 24*g* to the shift resistor 24*h*. The shift resistor 24*h* outputs the image data to the light emitting elements of the line 28*h*. The light emitting elements on the line 28*h* emit light to expose the same pixels on the line in the spot positions 33*a*.

In the same manner, the movement of the image carrier, the transmission of the image data to the respective shift resistors, and the output of the image data to the light emitting elements are sequentially conducted, thereby achieving multiple exposure relative to same pixels. In this case, the gradation control for neutral density can be conducted on the basis of the data prepared by the data processing means 23. Though the lines of which pixels are exposed and the lines of which pixels are not exposed are arranged alternately every line in the example of FIG. 3, two lines of which pixels are not exposed may be arranged between the lines which pixels are exposed. That is, the exposure to pixels is conducted on every third line. In this case, in FIG. 4, two shift resistors which transmit image data without outputting the image data are connected vertically and the third shift resistor conducts the control of light emitting elements. In this manner, the present invention can provide a variety of image formation on the image carrier.

According to the present invention, even when the interval in the sub scanning direction between the spot positions where the light emitting elements emit light to the image carrier is an integral multiple of the pixel pitch in the sub scanning direction, the multiple exposure of each pixel can be achieved by arranging the respective shift resistors to correspond to the line with light emitting elements and line without light emitting elements as shown in FIG. 3 and FIG. 4. In this case, the timing for transmitting image data stored in a shift resistor to the next shift resistor and the timing for making light emitting elements in the line to emit light on the basis on the image data stored in the shift resistor are synchronized, thereby simplifying the circuit structure and speeding up the operation. Though the spot position pitch in the sub scanning direction is twice as the pixel pitch in the example of FIG. 3, the spot position pitch may be other integral multiple of the pixel pitch. Therefore, the spot position pitch may be the same as the pixel pitch. In this case, the multiple number is 1.

Figure 5:
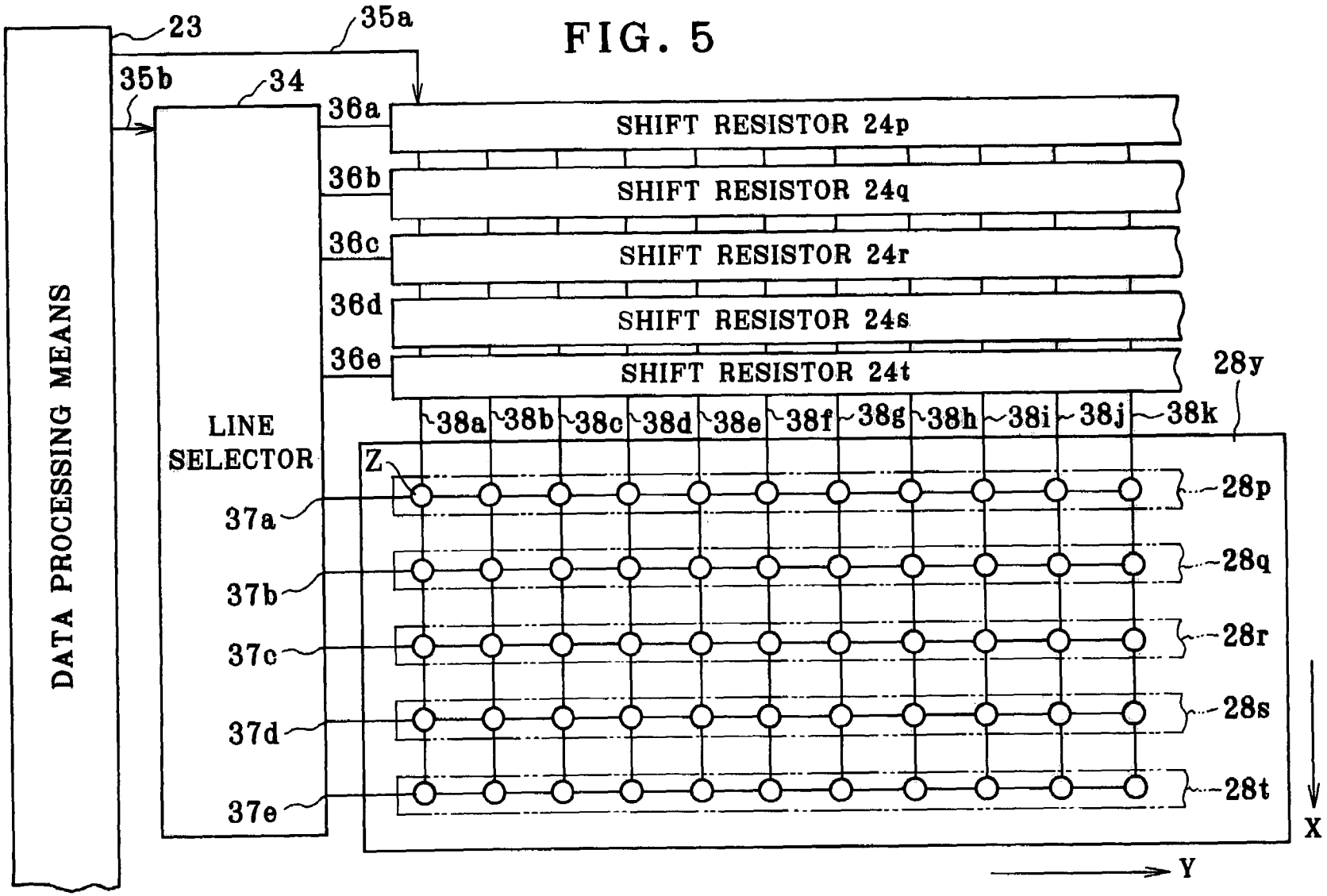
FIG. 5 is a block diagram showing a control unit of an image forming apparatus according to another embodiment of the present invention.

FIG. 5 is a block diagram showing an image forming apparatus according to another embodiment of the present invention. The example shown in FIG. 5 is an apparatus in which light emitting elements are driven in the active matrix method. In FIG. 5, "Z" indicates each single light emitting part composed of a light emitting element and a driving circuit arranged according to the active matrix method. Five lines of light emitting elements 28*p*–28*t* are arranged in a line head 28Y. Corresponding to the light emitting elements 28*p*–28*t* of the respective lines, shift resistors 24*p*–24*t* are arranged. Connected to a data processing means 23 is a line selector 34. Numeral 35*a* designates a supply line of image data from the data processing means 23 to the shift resistors, numeral 35*b* designates a control line connecting the data processing means 23 and the line selector 34, numerals 36*a*–36*e* designate command lines for commanding action from the line selector 34 to the respective shift resistors 24*p*–24*t*, numerals 37*a*–37*e* designate scanning lines for supplying signals from the line selector 34 to the light emitting elements of the respective lines, and numerals 38*a*–38*k* designate signal lines for supplying operational signals from the shift resistors 24*p*–24*t* to individual light emitting elements (organic ELs) in each line.

Description will now be made as regard to the operation of FIG. 5. According to a control signal supplied from the data processing means 23 through the control line 35*b*, the line selector 34 selects a scanning line 37*a* and sends a signal to the line for light emitting elements 28*p*. In addition, the line selector 34 activates the shift resistor 24*p* according to the signal through the command line 36*a*. The shift resistor 24*p* activates the signal lines 38*a*–38*k* to send output signals of image data to all of the light emitting elements 28*p* in the line. The light emitting elements 28*p* in the line emit lights to expose pixels. By shifting the scanning line 37 and the command line 36 according to the signal from the line selector 34, the above actions are also conducted for the light emitting elements 28*q*, 28*r*, 28*s*, and 28*t*, whereby the light emitting elements in all lines are activated to emit light to expose the pixels.

Then, the image data in the shift resistor 24*s* is transmitted to the shift resistor 24*t*. In the same manner, the image data is sequentially transmitted from the shift resistor 24*r* to the shift resistor 24*s*, from the shift resistor 24*q* to the shift resistor 24*r*, and the shift resistor 24*p* to the shift resistor 24*q*. To the shift resistor 24*p*, image data is transmitted from the data processing means 23 through the signal line 35*a*. During this, the image carrier is moved for the pixel pitch. Since the light emitting elements at the light emitting parts Z remain to emit light because of the function of the active matrix, the light emitting elements do not lights out even during the transmission of image data between the shift resistors, thereby exposing pixels with high luminance. By repeating the outputting of image data from the shift resistor 24 to the light emitting elements, the transmission of the image data between the shift resistors, and the movement of the image carrier, the image data onto the image carrier can be consecutively written.

Figure 6:
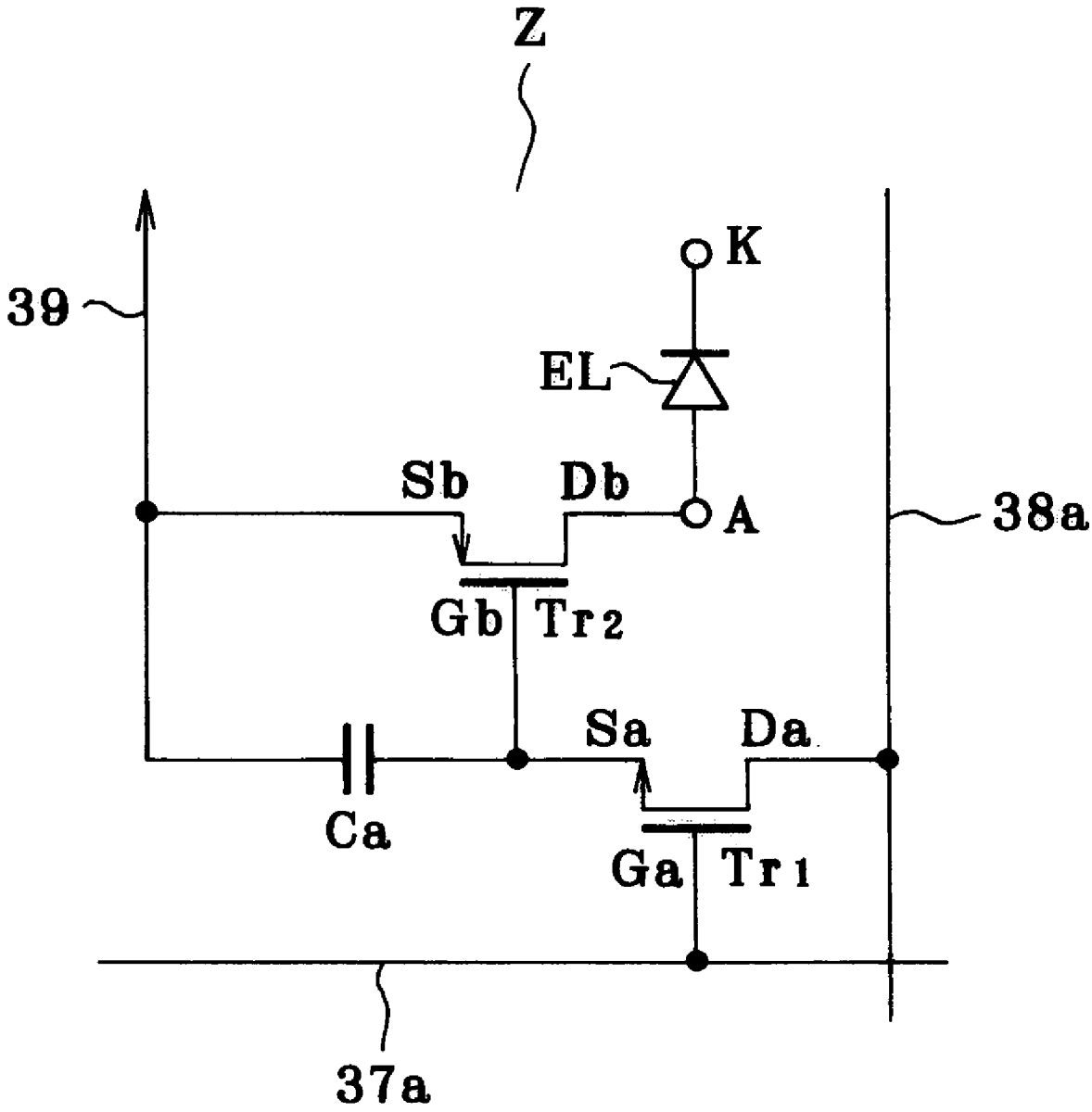
FIG. 6 is a circuit diagram showing a control circuit for light emitting elements which are driven in the active matrix method.

FIG. 6 is a circuit diagram for operating the light emitting parts Z according to the active matrix. In FIG. 6, an organic EL is employed as each light emitting element, "K" designates a cathode terminal thereof and "A" designates an anode terminal. The cathode terminal K is connected to a power source which is not shown. "37*a*" designates a scanning line which is connected to a gate Ga of a switching TFT (Tr1) "38*a*" designates a signal line which is connected to a drain Da of the switching TFT. "39" designates a power line and "Ca" designates a storage capacitor. A source Sb of a driving TFT (Tr2) of the organic EL is connected to the power line 39 and a drain Db is connected to the anode terminal A of the organic EL. In addition, a gate Gb of the driving TFT is connected to a source Sa of the switching TFT.

Description will now be made as regard to the operation of the circuit shown in FIG. 6. As the signal line 38*a* is energized in a state that a voltage of the power line 39 is applied to the source of the switching TFT, the switching TFT is turned ON. Accordingly, the gate voltage of the driving TFT is lowered and the voltage of the power line 39 is supplied from the source of the driving TFT so that the driving TFT becomes to the conducting state. As a result, the organic EL is activated to emit light of a predetermined luminance. In addition, the storage capacitor Ca is charged by the voltage of the power line 39. Even when the switching TFT is turned OFF, the driving TFT is still in the conducting state according to the charge stored in the storage capacitor Ca so that the organic EL remains to emit light. Therefore, by adopting the active matrix to the driving circuit for the light emitting elements, the operation of the organic EL is maintained to keep emitting light even when the switching TFT is turned OFF for transmitting the image data between the shift resistors, thereby exposing pixels with high luminance.

In the present invention, by controlling the light emitting elements in the pulse-width modulation (PWM) method, the control of the amount of emitting light is conducted. By the control according to the PWM method, the gradation control for the light emitting elements can be achieved. In the present invention, gradation data is formed by an 8-bit gradation data memory.

FIG. 7 is a table for explanation of an example of the relation between bit data and gradation data stored in gradation data memories. In the example of FIG. 7, the bit datum No. 1 is a gradation datum 0 (no light emission), the bit datum No. 8 is a datum of the most condensed density, and the bit data No. 2-No. 7 are data of neutral densities therebetween.

Figure 8:
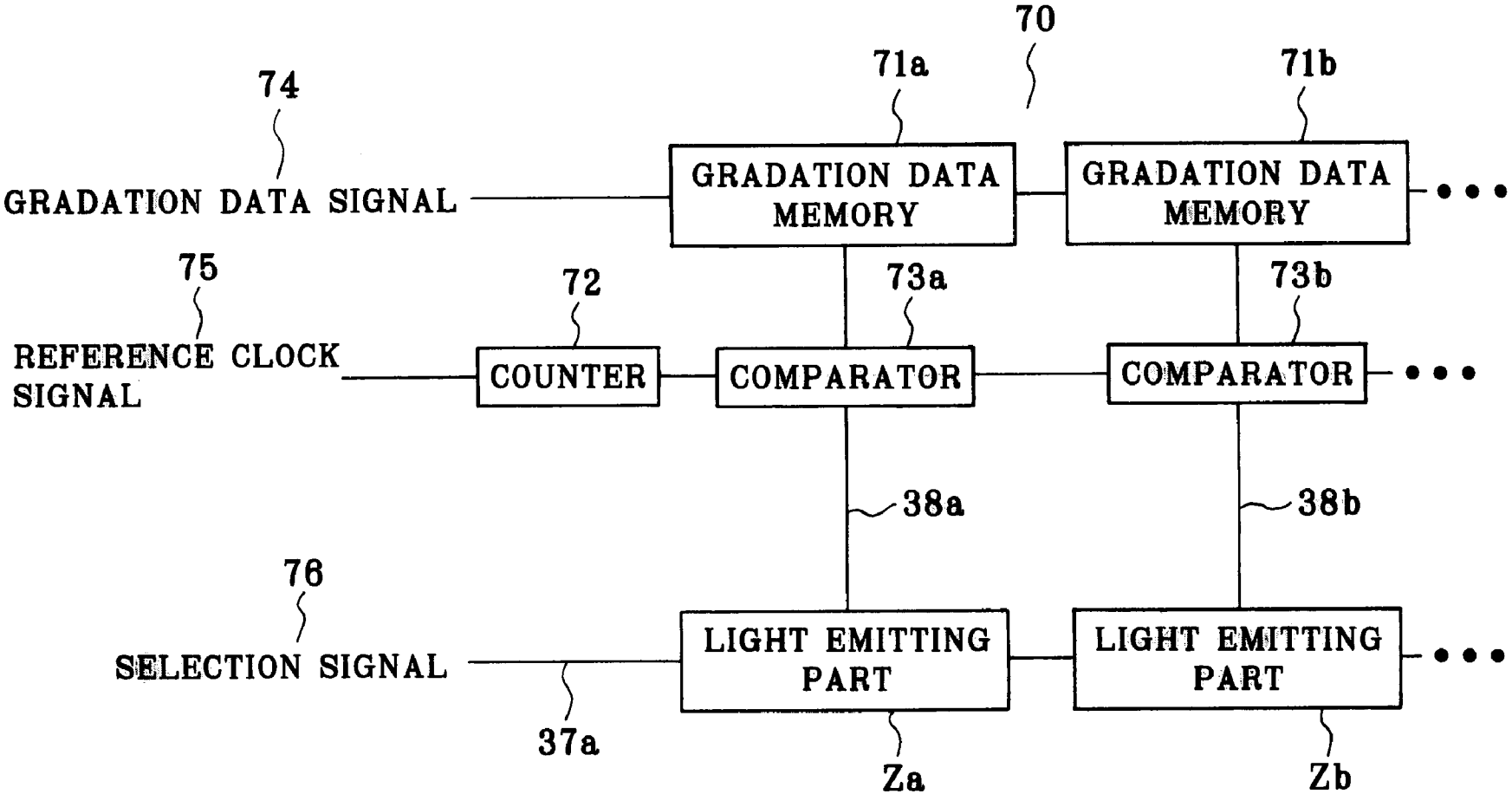
FIG. 8 is a block diagram of an example in which light emitting elements are controlled by the pulse-width modulation (PWM) method.

FIG. 8 is a block diagram of an example for conducting PWM control. In FIG. 8, a PWM control unit 70 is provided with gradation data memories 71*a*, 71*b* . . . composed of shift resistors or the like, a counter 72, comparators 73*a*, 73*b* . . . , and light emitting parts Za, Zb . . . . Supplied to the gradation data memories 71*a*, 71*b* . . . is a gradation data signal 74 from, for example, the data processing means 23 shown in FIG. 5. The gradation data memories 71*a*, 71*b* . . . are 8-bit memories as shown in FIG. 7. The counter 72 counts reference clock signal 75. The bit number of the counter 72 is eight bit which is the same as that of the gradation data memories 71*a*, 71*b* . . . so that the count repeats 0→the maximum (255)→0→the maximum. The comparators 73*a*, 73*b* compare the signal of the counter 72 to the gradation data stored in the gradation data memories 71*a*, 71*b* . . . . When the gradation data>the counter value, the switching TFT is turned ON as shown in FIG. 6. When the gradation data≦the counter value, the switching TFT is turned OFF.

FIGS. 9(*a*)–9(*c*) are characteristic graphs showing a concrete example of the PWM control shown in the block diagram of FIG. 8. FIG. 9(*a*) shows the output Da of the counter 72 which repeats 0→the maximum (255)→0→the maximum→0 . . . as described in the above. FIG. 9(*b*) shows the waveform Db of the signal outputted from the comparator, i.e. the operating characteristics of the switching TFT, when the gradation datum is the bit datum No. 7 (128 gradation level). In this case, the switching TFT is turned ON when the output of the counter is in a range of from 0 to 127, and the switching TFT is turned OFF when the output of the counter is in a range of from 128 to 255.

FIG. 9(*c*) shows the waveform Dc of the signal outputted from the comparator, i.e. the operating characteristics of the switching TFT, when the gradation datum is the bit datum No. 6 (64 gradation level). In this case, the switching TFT is turned ON when the output of the counter is in a range from 0 to 63, and the switching TFT is turned OFF when the output of the counter is 64 and 255. In case of FIG. 9(*b*), the pulse width of the waveform Db is Wa. In case of FIG. 9(*c*), the pulse width of the waveform Dc is Wb. That is, according to the size of the gradation data, the time period for which the switching TFT is turned ON is changed, thereby changing the amount of light emitted from the light emitting elements. Since the amount of exposure to the image carrier can be changed by ON/OFF of the light emitting elements according to the ON/OFF control of the switching TFT, the circuit structure can be simplified.

Figure 10:
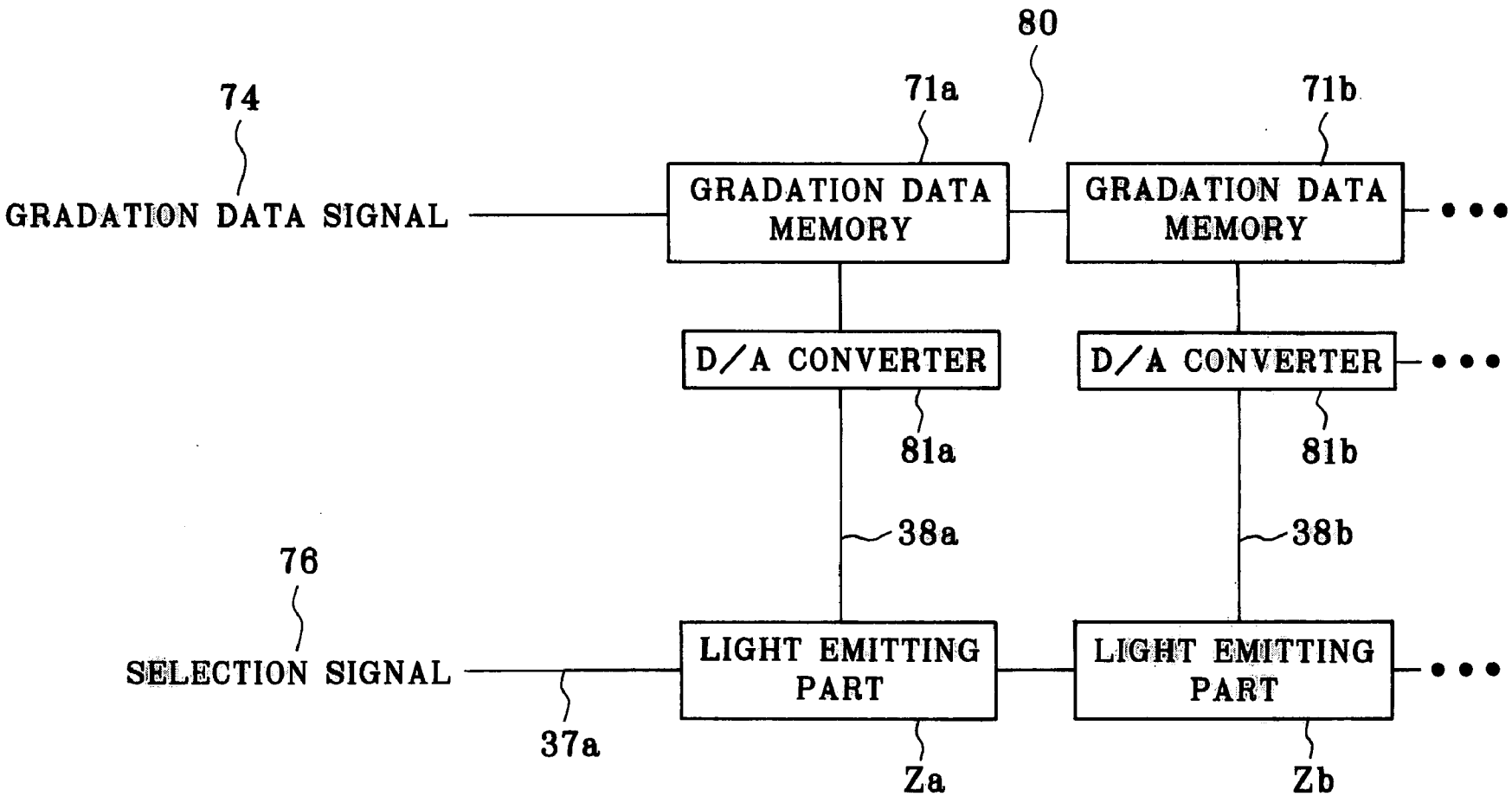
FIG. 10 is a block diagram of an example in which the light emitting elements are controlled by the intensity modulation method.

FIG. 10 is a block diagram showing another structure according to the present invention. The same parts as used in FIG. 8 are marked with the same numerals or marks, so the detail description about such parts will be omitted. The example shown in FIG. 10 controls the switching TFT with voltages or currents corresponding to the sizes of the gradation data. Such control as shown in FIG. 10 is called "Intensity Modulation" in the present invention. In an intensity modulation control unit 80 shown in FIG. 10, D/A converters 81*a*, 81*b* . . . are connected to the gradation data memories 71*a*, 71*b* . . . , respectively. The D/A converters 81*a*, 81*b* . . . form voltage values or current values of analog corresponding to the sizes of the gradation data stored in the gradation data memories 71*a*, 71*b* . . . and output the voltage values or current values to the switching TFTs, respectively.

In the example of FIG. 10, the amount of light emitted from the light emitting elements is changed by changing the bias of the switching TFT corresponding to the gradation data. Therefore, it is not required to control the ON/OFF of the light emitting elements at a high speed. Even when the speed of response of the light emitting elements is slow, the amount of exposure to the image carrier can be changed at a high speed. Light emitting parts Za, Zb . . . are driven in the active matrix method shown in FIG. 6. Supplied to the light emitting parts Za, Zb . . . are a select signal through a scanning line 37*a* and control signals through emission control data lines 38*a*, 38*b*. . . .

Figure 11:
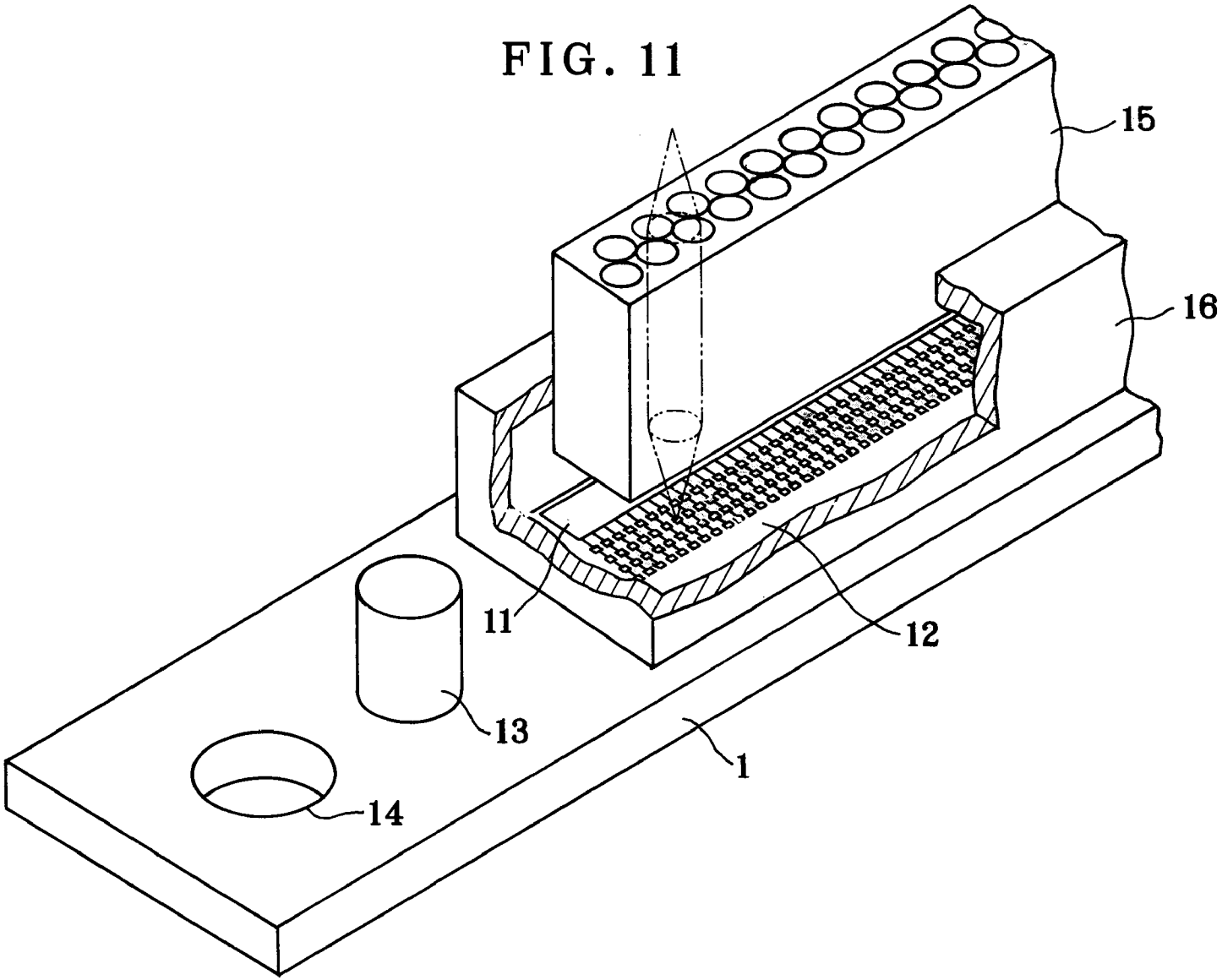
FIG. 11 is a perspective view showing an example of organic EL arrays according to an embodiment of the present invention.

In the present invention, organic EL (organic electroluminescence element) arrays are employed in lines of light emitting elements for multiple exposure. FIG. 11 is a perspective view showing an example of the organic EL array to be employed in the image forming apparatus of the present invention. In FIG. 11, an organic EL array 12 is mounted on a rectangular substrate 1 made of glass or the like. The organic ELs are connected to a driving circuit 11 for controlling the emission. The rectangular substrate 1 is provided with positioning pins 13 and through holes 14 for installation formed on both sides thereof. Numeral 16 designates a protective cover for covering the driving circuit 11 and the organic EL array 12. A condensing rod lens array 15 as magnifying optical system is fixed on the side of the image carrier. Because of the condensing function of the condensing rod lens array 15, light-emitting parts of the organic EL array 12 are condensed to form an image on a photosensitive surface of the image carrier.

Figure 12:
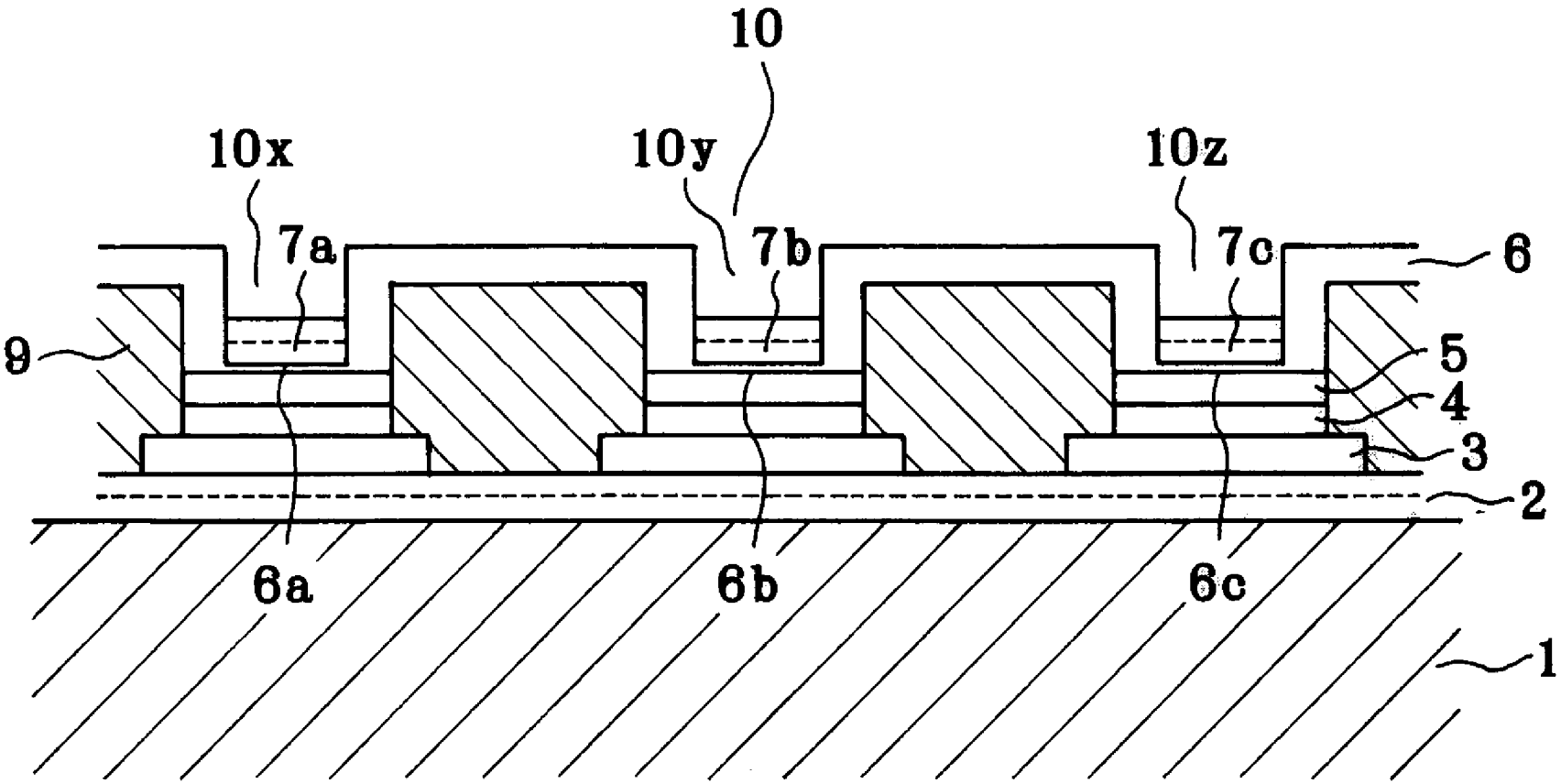
FIG. 12 is a sectional view showing the schematic structure of the organic EL arrays.

FIG. 12 is a vertical sectional front view showing an example of an organic EL array head 10. In FIG. 12, a reflection layer 2 composed of dielectric multi-layered film is formed on the substrate 1, made of glass or a resin film, by the spattering method. The reflection layer 2 composed of a dielectric multi-layered film may be formed of, for example, a pair of layers made of $SiO_2$ and $TiO_2$. The reflective layer 2 formed of such a dielectric multi-layered film has reflectance of 0.99 or more.

An anode 3 is formed on the reflection layer 2 by the spattering method. The anode 3 is made of a light-transmitting and conductive material. As an example of the material having such characteristics, ITO (indium tin oxide) having large working function may be used. Then, a hole transportation layer 4 is formed on the anode 3 by the inkjet method. After forming the hole transportation layer 4, ink composition is discharged into the hole (not shown) from a head of an ink-jet printing device, thereby achieving the patterning application on the emitting layer of the pixel. After the application, the solvent is removed and the applied ink composition is treated by heat, thereby forming a light-emitting layer 5.

The organic EL layer composed of the hole transportation layer 4 and the emitting layer 5 may be formed by other known method such as a spin coating method, a dipping method, and other liquid phase deposition method instead of applying ink compositions by inkjet method as the above. The material of the hole transportation layer 4 and the emitting layer 5 may be known EL materials listed in Japanese Patent Unexamined Publication No. H10-12377 and Japanese Patent Unexamined Publication No. 2000-323276, so description about details will be omitted. Then, a cathode 6 is formed by vapor deposition method. As the material of the cathode 6, for example, Al may be employed.

The organic EL array head 10 has thin layer portions 6*a*–6*c* formed at the cathodes 6 having a U-like section corresponding to light emitting parts 10*x*–10*z*. The thin layer portions 6*a*–6*c* are formed to have such a thickness in holes of a wall 9 as to allow light transmission. At the light emitting parts 10$x$–10$z$, semi-transparent reflection layers (dielectric mirrors) 7 composed of a plurality of dielectric multi-layered films are formed on the bottoms of the cathodes 6 by the spattering method. The semi-transparent reflection layers 7$a$–7$c$ composed of dielectric multi-layered films may be formed of, for example, three pairs of layers made of $SiO_2$ and $TiO_2$. The semi-transparent reflection layers 7 formed of such dielectric multi-layered films according to the present invention has reflectance of about 0.9. In the embodiment of FIG. 12, as mentioned above, the thin layer portions 6$a$–6$c$ are formed at the cathodes 6, thereby allowing light transmittance. Accordingly, even when the organic EL layer composed of the hole transportation layer 4 and the emitting layer 5 is formed by a liquid phase deposition method such as the inkjet method, it is free from the possible problem that the reflectance is reduced due to the smoothness of contact portion between the EL layer and the cathode. In the present invention, the organic EL array head having the aforementioned structure can be used as an exposure head of an image forming apparatus, for example, capable of forming a color image by using electrophotographic technique.

Figure 13:
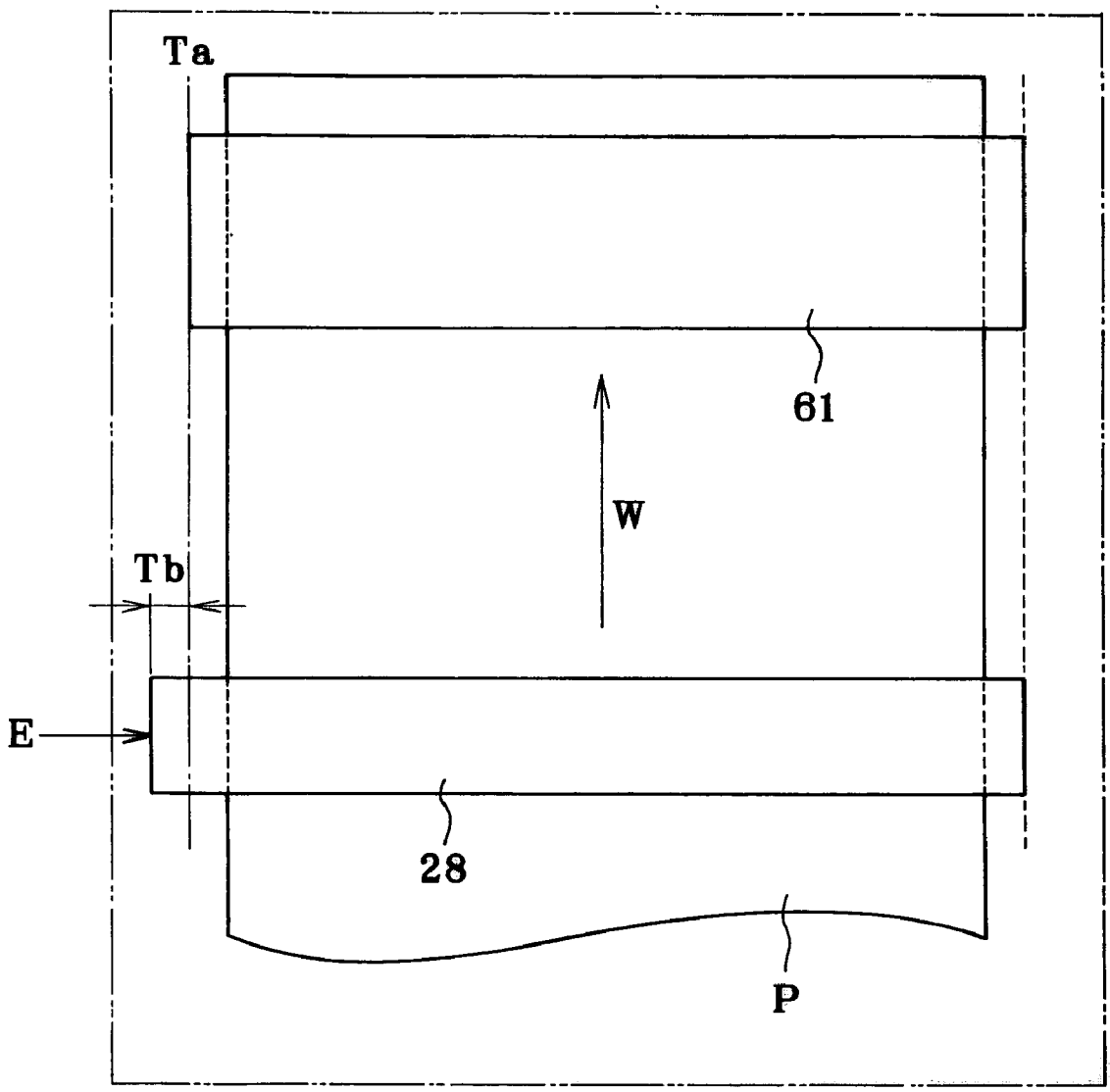
FIG. 13 is an explanatory illustration showing a conventional example.
Figures 14A, 14B:
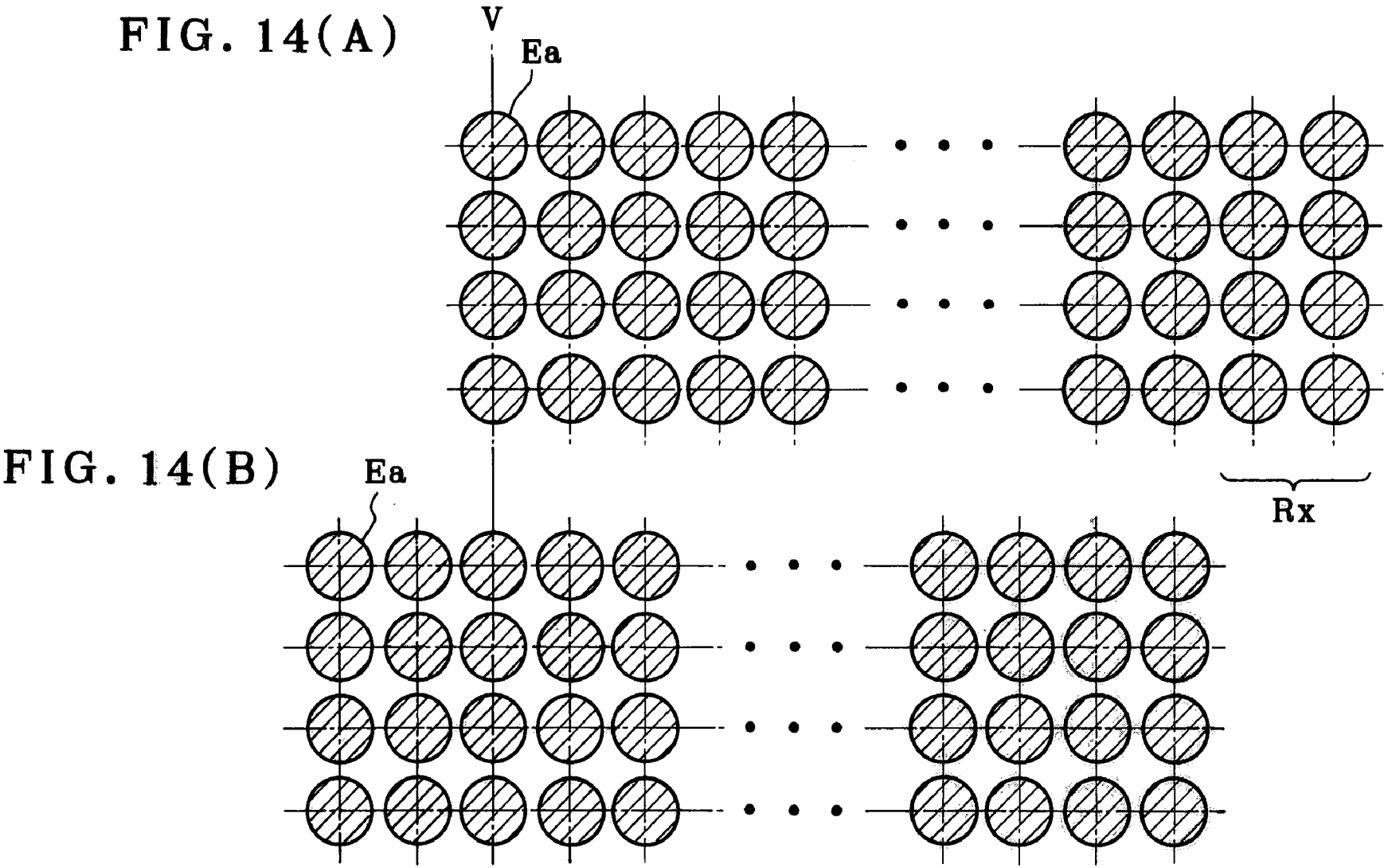
FIGS. 14(A), 14(B) are explanatory illustrations showing an example of image formation by the conventional example shown in FIG. 13.

By the way, a line head in which light emitting elements are aligned in a plurality of rows has a possible problem that the mounted position of the head to an apparatus is easily shifted due to a problem caused in the manufacturing process. FIG. 13 is an explanatory illustration showing an example where the line head is installed to the apparatus in a state that the mounted position of the line head is shifted. In FIG. 13, numeral 28 designates a line head, 61 designates a pair of fixing rollers (fixing device), "P" designates a paper sheet, "W" designates the feeding direction of the paper sheet P. "Ta" designates the normal mounted position of the line head 28. In the example shown in FIG. 13, the installed line head is shifted so that the position of one edge of the line head protrudes from the normal mounted position Ta. Therefore, there is an installation error Tb. As the line head is installed to the apparatus body in a state that the mounted position of the line head is shifted from the normal mounted position, the image exposure position is also shifted. Consequently, it is impossible to form a part of image, thus providing significantly poor image quality. FIGS. 14(A), 14(B) are explanatory illustrations showing an example where a part of image is not formed as mentioned above.

FIG. 14(A) shows an example of image formation when the line head is installed at the normal position. In this case, image is formed on a paper sheet P including the front row Ea of the image from the image formation reference position V. On the other hand, FIG. 14(B) shows a case where the line head 28 is installed at a position shifted from the normal position as shown in FIG. 13, the image is formed on a paper sheet P such that the front row Ea is shifted for two rows. In a color printer having respective exposure units for four colors, the respective exposure units are independently installed and the alignment among images formed by the respective exposure units is difficult. Unless each exposure unit is installed to a position precisely parallel to the other exposure units, toner images of respective colors are never neatly superposed on each other, thus providing poor image quality. To prevent the misalignment among the respective exposure units as shown in FIG. 13, it is required to improve the accuracy in alignment of the entire printer, causing a problem of increasing the cost. In addition, it is necessary to conduct alignment of the respective exposure units with test printing so that there is a problem that the alignment takes time and makes the operation complex.

Figure 15:
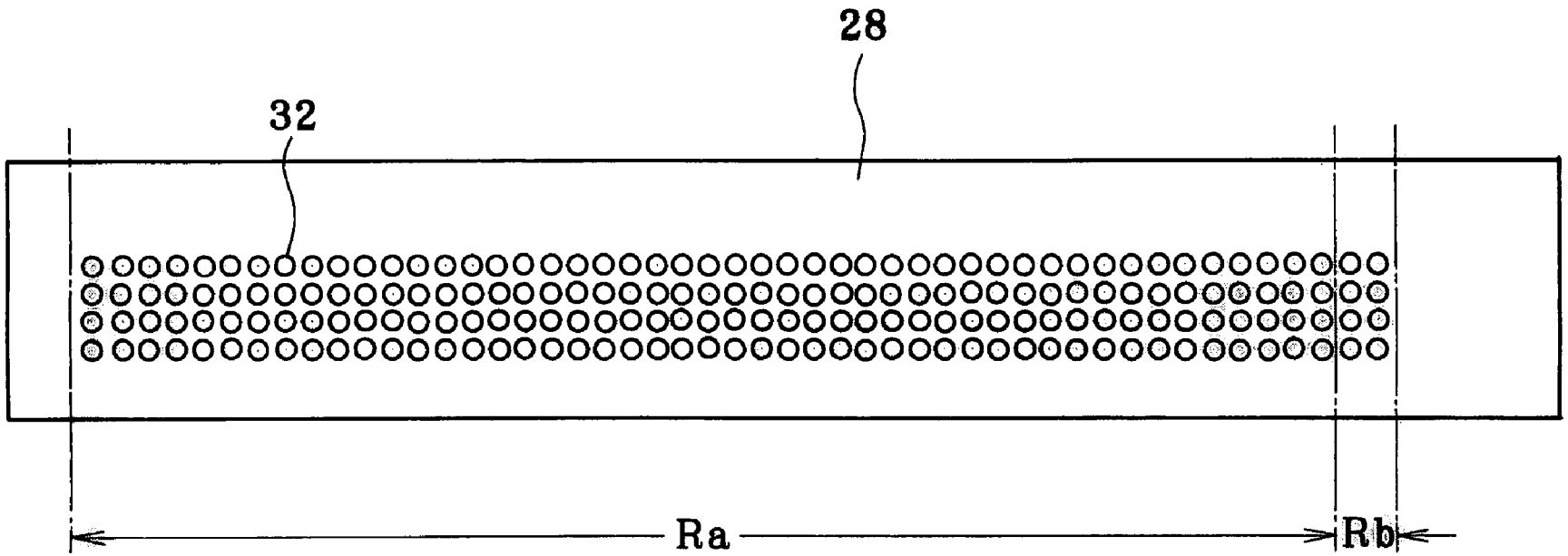
FIG. 15 is a plan view showing a line head according to another embodiment of the present invention.

Even when the mounted position of the line head is shifted from the normal position as mentioned above, an embodiment of the present invention can maintain the image quality without complex alignment of the mounted positions of line heads. FIG. 15 is a plan view showing a line head of the present invention. In FIG. 15, the line head 28 has a large number of light emitting elements 32 which are aligned in a plurality of rows and in a plurality of lines.

In the line head 28 shown in FIG. 15, light emitting elements from one end to rows Ra in the longitudinal direction are light emitting elements for normal exposure. Light emitting elements of two rows from the other end are light emitting elements which are preliminarily arranged for adjusting the position of image (resist light emitting elements). Though the number of rows of resist light emitting elements is two in the embodiment shown in FIG. 15, the number is not limited to two and may be suitably set.

Figure 16A:
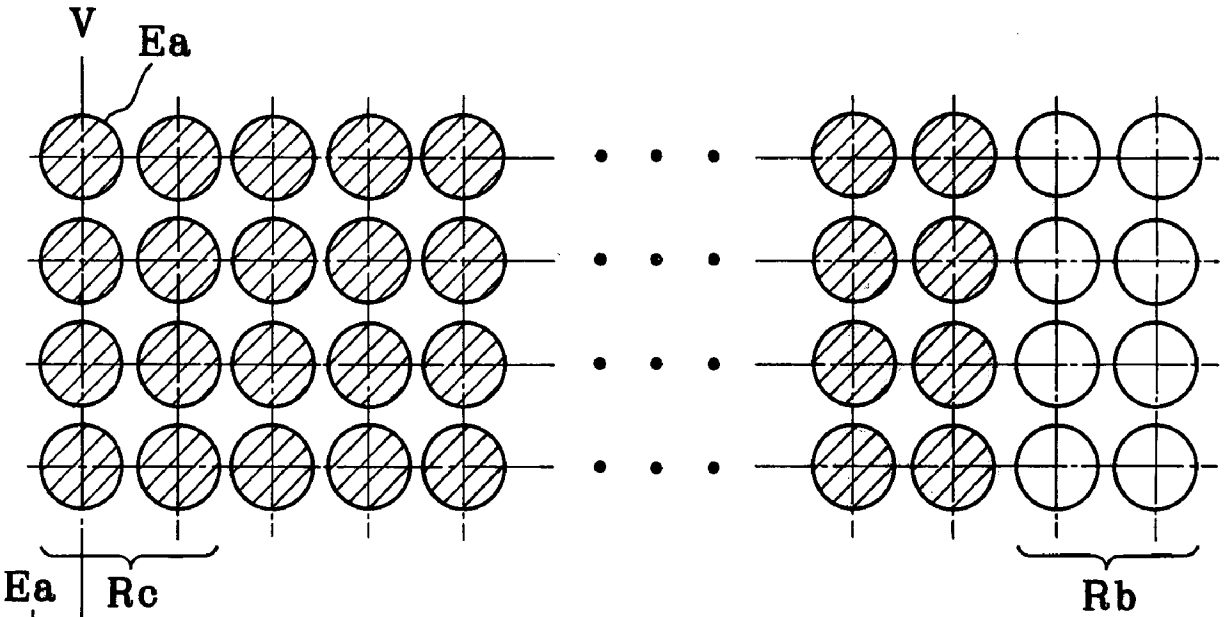
FIGS. 16(A), 16(B) are explanatory illustrations showing an example of image formation by the embodiment shown in FIG. 15.
Figure 16B:
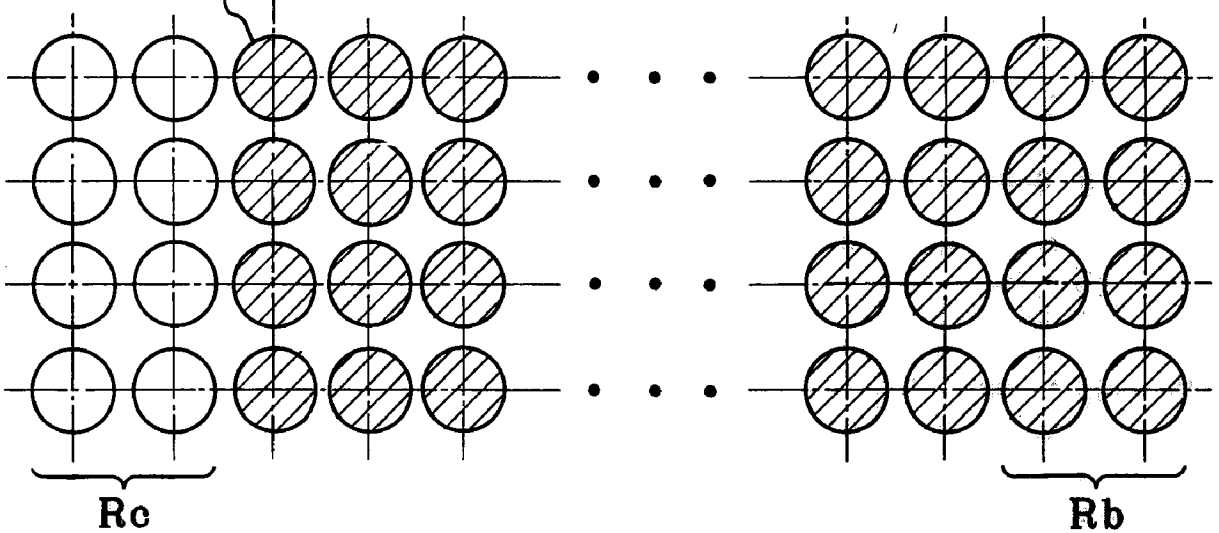

FIGS. 16(A), 16(B) are explanatory illustrations showing an example of image formation by the line head shown in FIG. 15. FIG. 16(A) shows a normal image, "Rc" indicates light emitting elements in two rows on the front side, and "Rb" indicates resist light emitting elements in two rows on the rear side. Hatched circles indicate pixels to be formed and open circles indicate pixels to be not formed. "V" designates the image forming reference position and "Ea" is the first row of the portion where image is formed. FIG. 16(B) shows an image after corrected. In this case, image is not formed by the light emitting elements Rc in the two rows of the front side while image is formed by the light emitting elements (resist light emitting elements) Rb in the two row of the rear side. Therefore, even when the line head is installed to the apparatus at a position shifted from the normal position, the image quality can be maintained. In FIGS. 16(A), 16(B), the light emitting element lines are arranged in a plurality of lines, thereby conducting the multiple exposure.

Now, the control example for correcting the misalignment as shown in FIGS. 16(A), 16(B) will be described with reference to FIG. 5. As the line head 28 is installed to the apparatus at a position shifted from the normal position as shown in FIG. 13, information of misalignment is obtained by a sensor which is not shown in drawing. The information of misalignment is stored in a suitable storing means, for example, a memory in the data processing means 23 in FIG. 5. When signals are sent from the data processing means 23 to the shift resistors 24$p$–24$t$ for actuating the respective light emitting elements, blank data are outputted through the signal lines 38$a$, 38$b$ for all of the light emitting element lines 28$p$–28$t$ so that the light emitting elements in two rows on the front side do not form image.

Figures 17C, 17K, 17M, 17Y:
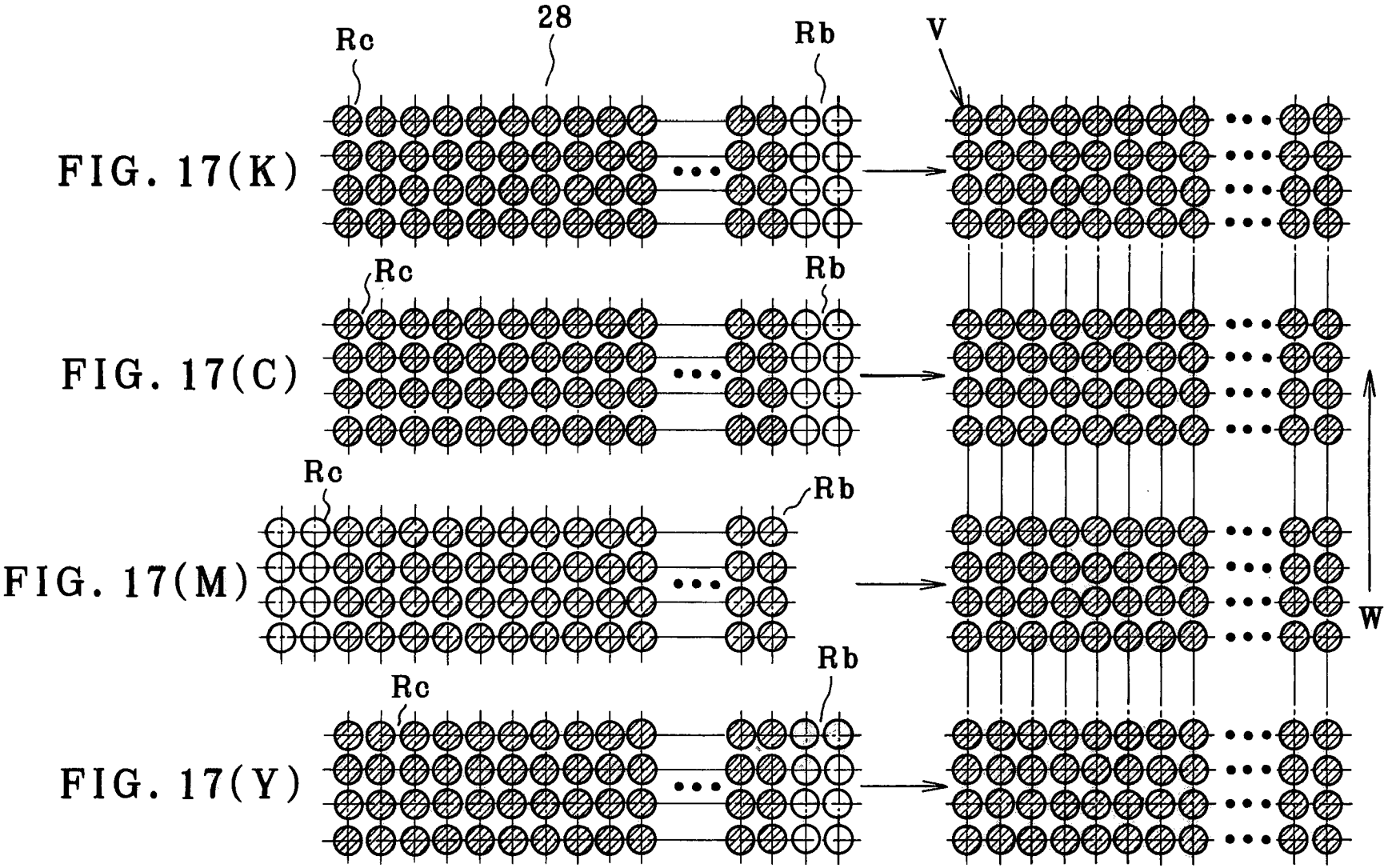
FIG. 17 is an explanatory illustration showing an example of color image formation after correction of color registration error.

FIG. 17 is an explanatory illustration showing an example of color image formation according to the present invention. In FIG. 17, (K) shows a black image, (C) shows a cyan image, (M) shows a magenta image, and (Y) shows an yellow image. In this example, the position of the line head for magenta is shifted. The correction as described in FIGS. 16(A), 16(B) is conducted relative to the line head for magenta. Accordingly, when four unicolor images are superposed on each other, suitable image formation can be conducted because the effect of misalignment in mounted positions of the line head is corrected.

Figures 18A, 18B:
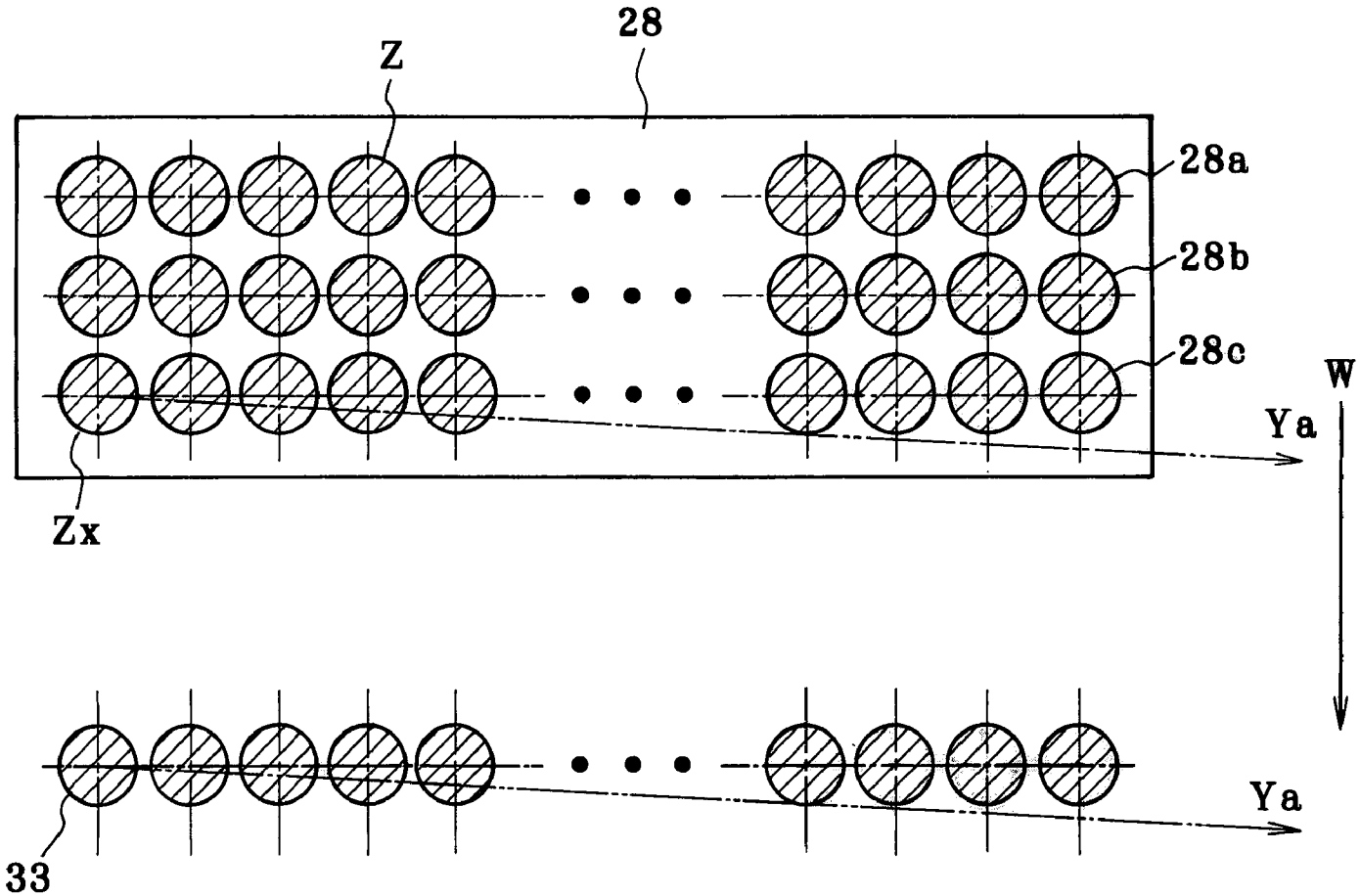
FIGS. 18(A), 18(B) are explanatory illustrations showing a conventional example.

The line head in which light emitting elements are aligned in a plurality of rows has a possible problem that the mounted position of the head to an apparatus is easily tilted relative to the main scanning direction due to a problem caused in the manufacturing process. FIGS. 18(A), 18(B) are explanatory illustrations showing an example where the line head is installed to the apparatus in a tilted state. FIG. 18(A) shows a line head 28. The line head 28 has light emitting element lines 28*a*–28*c* each provided with a plurality of light-emitting elements Z in the main scanning direction. Here, "Ya" indicates the main scanning direction and "W" indicates the paper feeding direction (sub scanning direction). In the example shown in FIG. 18(A), the line head 28 is installed to the apparatus in a state tilted relative to the main scanning direction Ya. For example, a light emitting element Zx arranged at one end of the line head 28 is out of position of the main scanning direction Ya. In this case, the line of formed image 33 is not parallel to the line of the main scanning direction Ya as shown in FIG. 18(B). As the mounted position of the line head is tilted relative to the main scanning direction, the exposure position for image is shifted so that the line of pixels which should be formed parallel to the main scanning direction under normal conditions has an angle relative to the main scanning direction, thus causing a problem of deteriorating printing quality.

Figure 19:
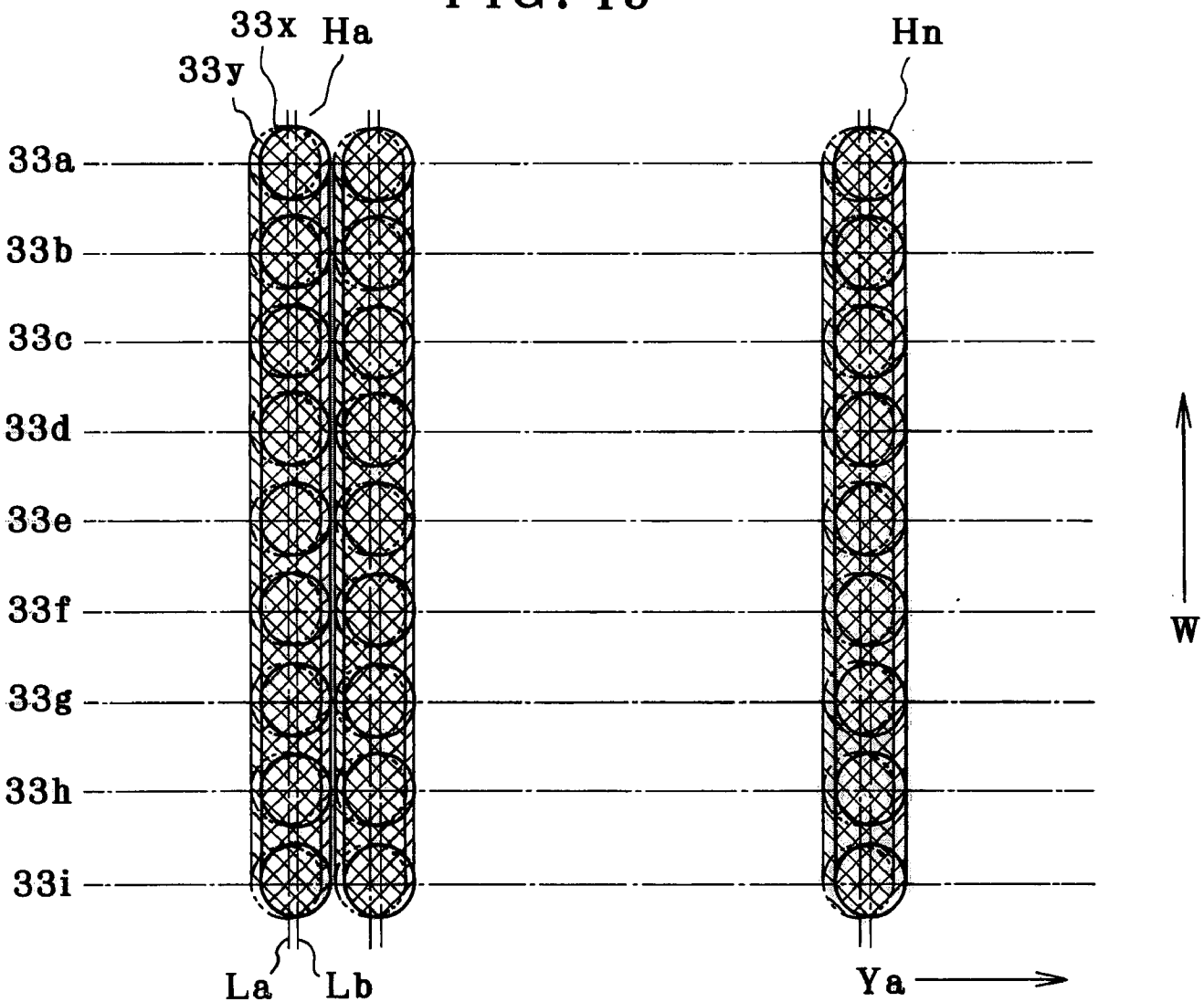
FIG. 19 is an explanatory illustration showing a conventional example.

FIG. 19 is an explanatory illustration showing an example of image formation in case where the line head is tilted relative to the main scanning direction as shown in FIGS. 18(A), 18(B). In FIG. 19, numerals 33*a*–33*i* designate pixel lines and Ha-Hn designate pixel rows. In this case, the exposure line width of the pixel rows Ha-Hn is increased. That is, pixels 33*x* to be formed on the central line La under normal conditions become pixels 33*y* shifted to have a central line Lb, thus increasing the exposure line width in the main scanning direction Ya. Accordingly, there is a problem that the outlines of pixels which are adjacent to each other in the main scanning direction are superposed on each other so that the image must be fuzzy and the image quality is poor. In a color printer having respective exposure units for four colors, the respective exposure units (line heads) are independently installed and the alignment among images formed by the respective exposure units is difficult. As one of the exposure units is installed to the apparatus in s state tilted relative to the main scanning direction, the respective unicolor toner images can not be neatly superposed on each other, thus deteriorating the image quality.

Figures 20C, 20K, 20M, 20Y:
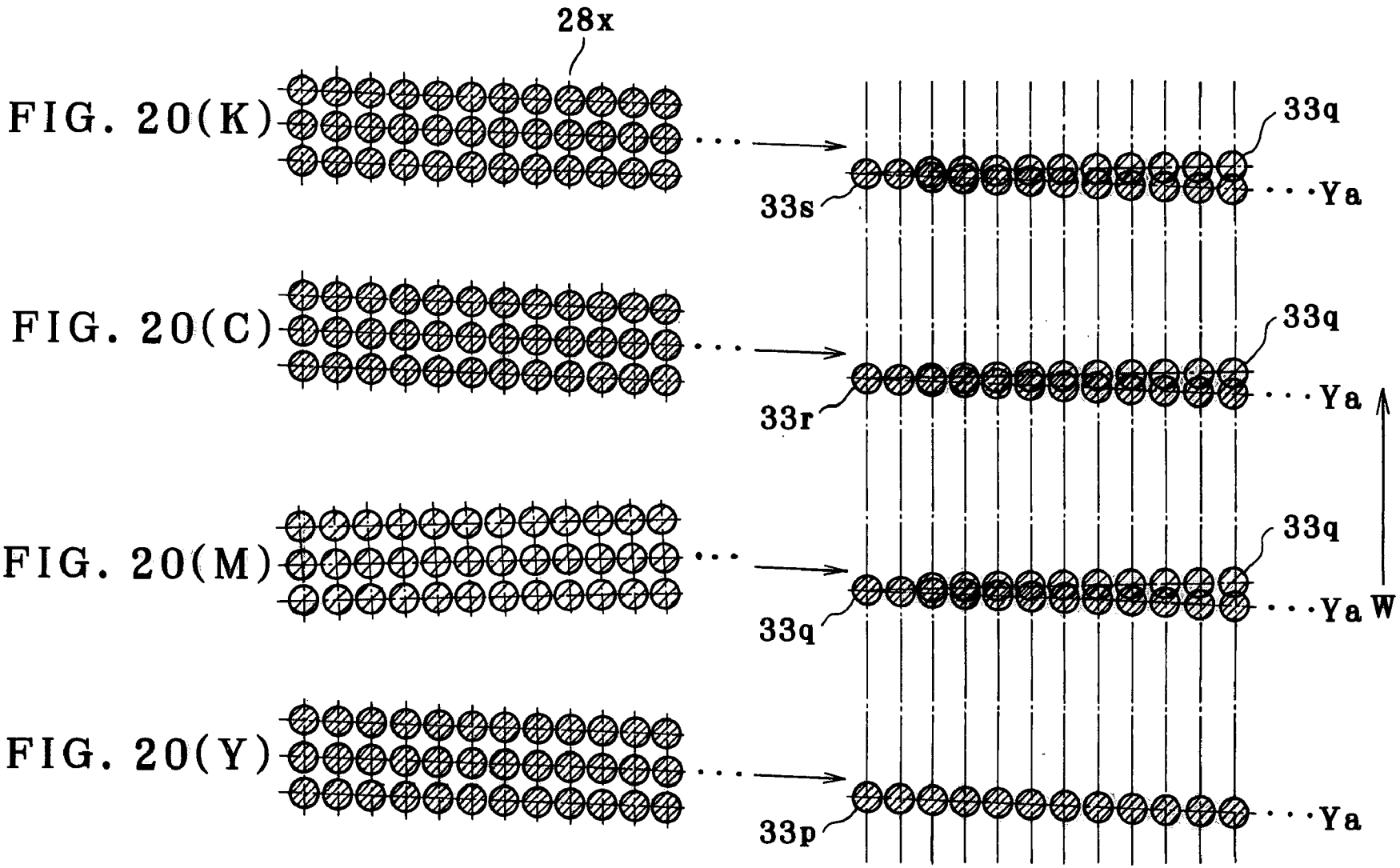
FIG. 20 is an explanatory illustration showing a conventional example.

FIG. 20 is an explanatory illustration showing an example of image formation in case where line heads are installed to the apparatus body of a color printer in a state tilted relative to the main scanning direction. The line heads 28*x* shown in FIG. 20 are a line head for black (K), a line head for cyan (C), a line head for magenta (M), and a line head for yellow (Y). Each line head has a plurality of light emitting element lines. In the example shown in FIG. 20, the line head for magenta (M) is installed to the apparatus in a state tilted relative to the main scanning direction Ya. First, a pixel line 33*p* is formed on a paper sheet by the line head for yellow (Y). Then, the paper sheet is fed in the direction W and a pixel line 33*q* is formed to be superposed on the pixel line 33*p* on the paper sheet by the line head for magenta (M).

Since the line head for magenta (M) is tilted relative to the main scanning direction Ya, however, the pixel line 33*q* is not neatly superposed on the pixel line 33*p*. Then, the paper sheet is fed in the direction W and a pixel line 33*r* is formed to be superposed on the pixel line 33*p* by the line head for cyan (C). The paper sheet is further fed in the direction W and a pixel line 33*s* is formed to be superposed on the pixel lines 33*p*, 33*r* by the line head for black (K). Therefore, in the example of FIG. 20, the pixel line 33*q* formed by the line head for magenta (M) is not parallel to the line in the main scanning direction, thus causing color registration error relative to other colors and deteriorating the printing quality.

To prevent any one of the line heads for exposure of plural colors from being tilted like the above example, it is required to improve the accuracy in alignment of the entire printer, causing a problem of increasing the cost. In addition, it is necessary to conduct alignment of the respective line heads with test printing so that there is a problem that the alignment takes time and makes the operation complex.

Figure 21A:
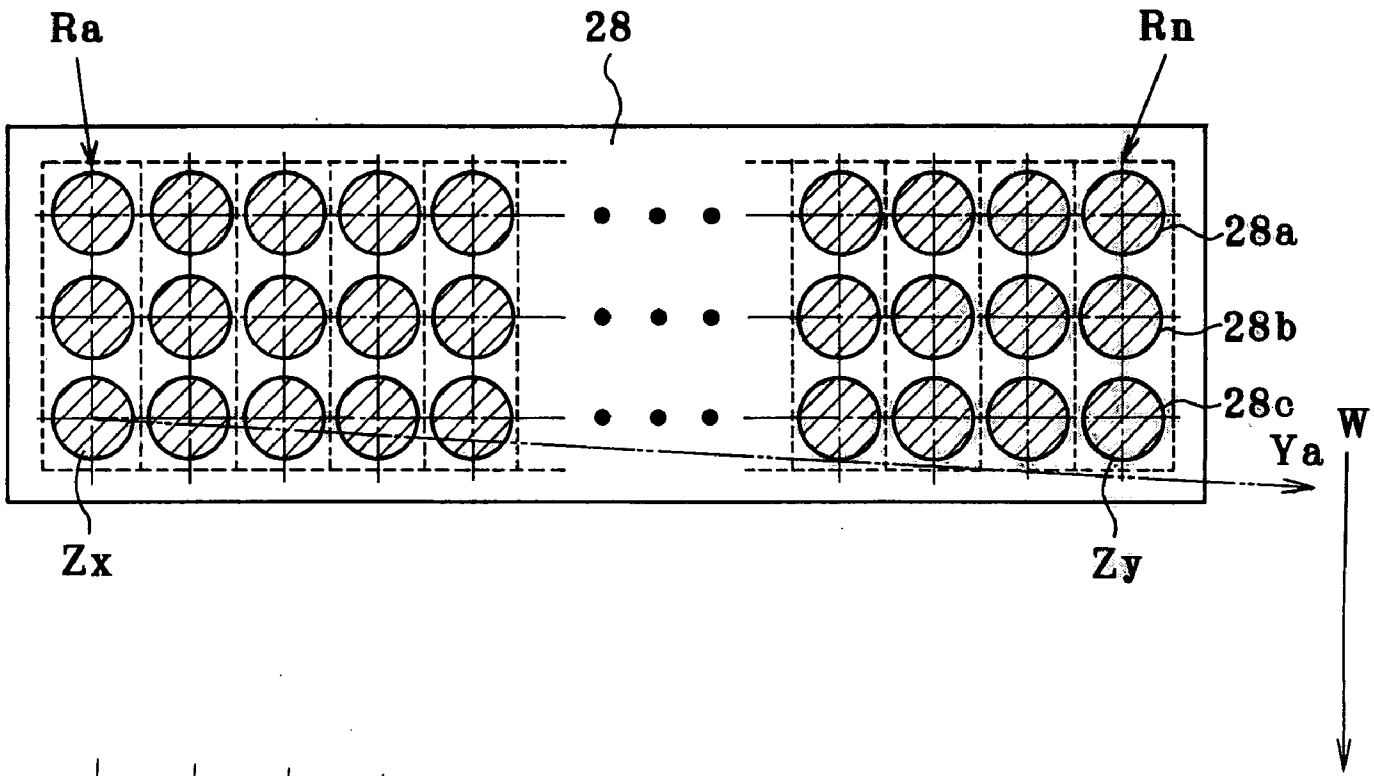
FIGS. 21(A), 21(B) are explanatory illustrations showing an example of image formation according to the present invention.
Figure 21B:
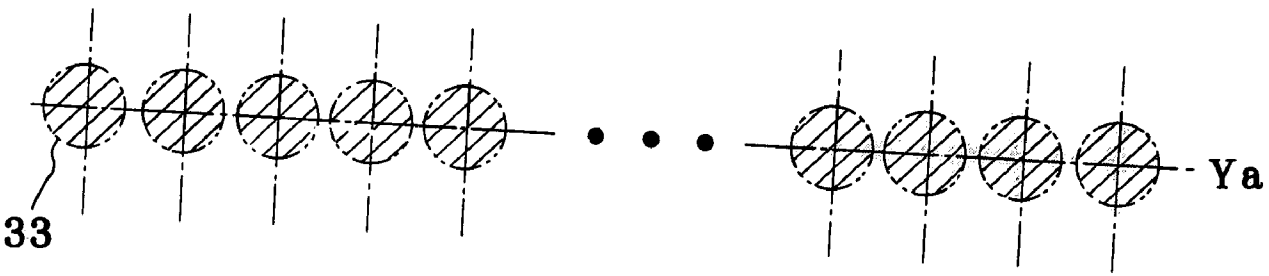

FIGS. 21(A), 21(B) are explanatory illustrations showing the structure of another embodiment according to the present invention. FIG. 21(A) shows a line head. The line head 28 has light emitting element lines 28*a*–28*c*. In the example shown in FIG. 21(A), the line head 28 is installed to the apparatus in a state tilted relative to the main scanning direction Ya. FIG. 21(B) shows an image after the misalignment due to the tilt of the line head is corrected. In the line head 28, a plurality of light emitting element lines each having a plurality of light emitting elements are arranged to have rows in the sub scanning direction of the image carrier (the paper feeding direction w) so that light emitting elements are arranged in a matrix in a plane. This embodiment of the present invention is characterized by shifting the timing of operation in a direction of the light emitting element rows Ra-Rn during the light emitting elements on the light emitting element lines 28*a*–28*c* are operated.

That is, as taken from the paper feeding direction W, the operation timing for the pixel row Ra, of which the front light emitting element Zx protrudes from the main scanning direction Ya, is delayed for a predetermined period of time. It should be noted that, in the present invention, the array of light emitting elements in the main scanning direction is referred to as a light emitting element line and the array of light emitting elements in the paper feeding direction (sub scanning direction) is referred to as a light emitting element row. The pixel row Rn, of which the front light emitting element Zy does not protrude from the main scanning direction Ya, is set not to delay the operation timing. In the example shown in FIG. 21(A), the light emitting element lines 28*a*–28*c* are tilted linearly relative to the main scanning direction Ya. The times for delaying the operation timing of the respective pixel rows are set to increase gradually from Rn to Ra. By this control, the pixel line 33 is formed to be parallel to the line of the main scanning direction Ya as shown in FIG. 21(B), thereby canceling the misalignment in image and preventing the deterioration of printing quality.

Figure 22:
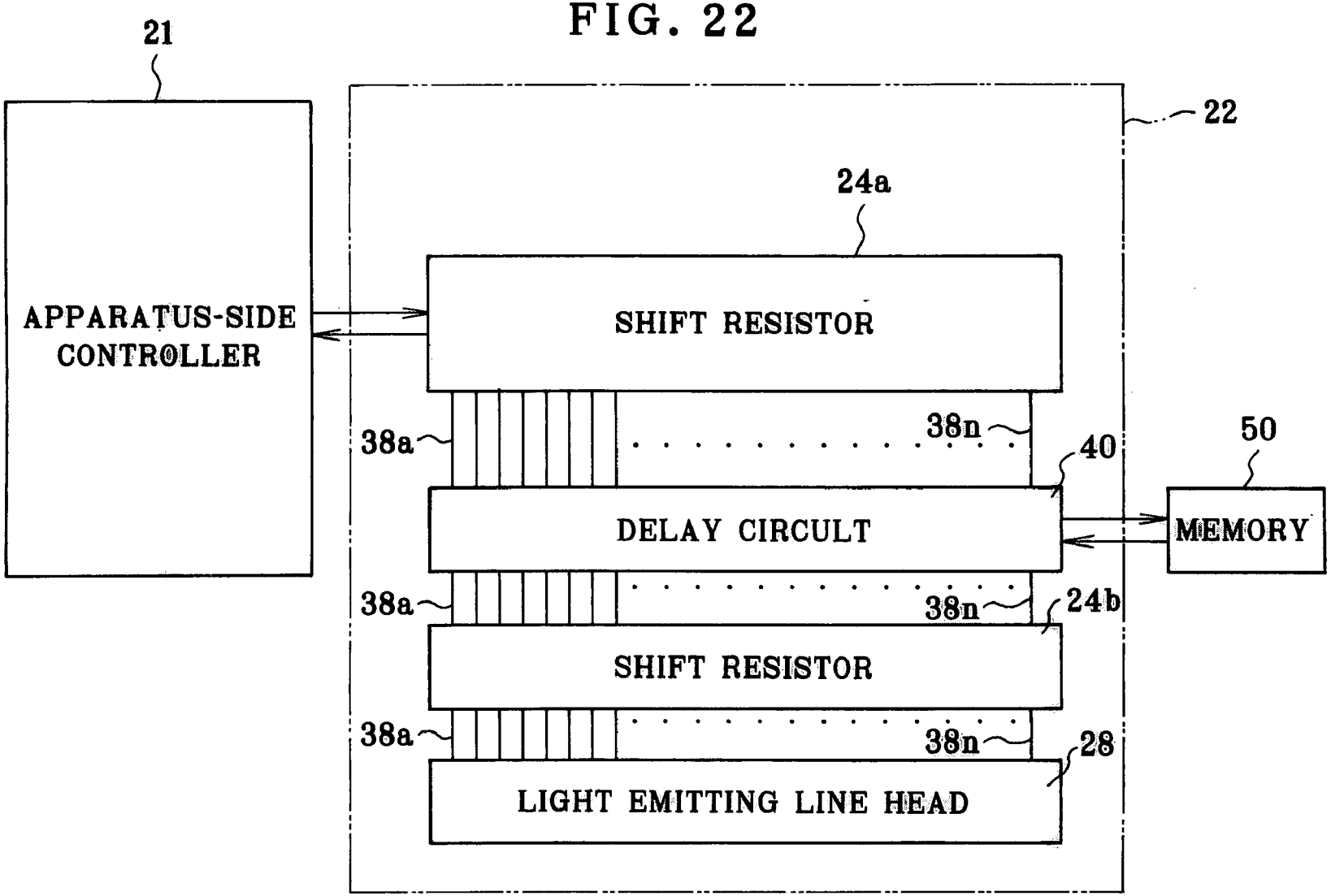
FIG. 22 is a block diagram showing an example of an image forming apparatus according to the present invention.

FIG. 22 is a block diagram showing the structure of a control unit in an image forming apparatus of the present invention. In FIG. 22, numeral 22 designates a control unit for an engine controller. An apparatus-side controller 21 inputs image data to the first shift resistor 24*a* in the control unit 22. The first shift resistor 24*a* outputs the image data to respective light emitting lines of the light emitting element line head 28. That is, the first shift resistor 24*a* functions as an image data supplying means for supplying image data to the respective light emitting elements. In the embodiment of the present invention, the respective light emitting element rows are operated with the respective delayed timing as described above with reference to FIG. 21(A). Therefore, the output signal of the first shift resistor 24*a* is delayed for a predetermined period of time via a delay circuit 40. Delay signals outputted from the delay circuit 40 through signal lines 38*a*–38*n* are formed according to the tilt information previously stored in a memory 50. The memory 50 stores the tilt information of the line head.

The tilt information of the line head is obtained from the memory 50 and the delay circuit 40 sets the level of delay time for each light emitting element row according to the degree of tilt of the light emitting element lines relative to the main scanning direction. The output signal from the delay circuit 40 is given to the light emitting element line head 28 through the second shift resistor 24*b*. The second shift resistor 24*b* outputs signals through signal lines 38*a*–38*n*, thereby sequentially operating the light emitting elements of the light emitting element lines 28*a*–28*c* of FIG. 21(A).

As mentioned above, in the control unit 22, the image data supplied from the delay circuit 40 to the light emitting elements are controlled to be delayed according to the tilt information of the line head stored in the memory 50 in such a manner as to correct image positions of pixels on an image carrier from tilting due to the tilt of the line head. The delay control for the timing of supplying image data to the light emitting elements can be carried out, for example, by providing a CPU, which is not shown in drawing, to the delay circuit. The aforementioned memory 50 may be arranged in the engine controller separately from the line head. In this case, even when the line head is out of order for any reason, the tilt information of the line head can be securely maintained. The memory 50 may be formed integrally with the line head 28. In this case, since tilt information of new line head is stored in a memory (storage means) during the replacement of the line head, the control for light emitting element rows can be conducted according to the tilt information. The storage means may be formed in a cartridge including exposure units as will be described later. In this case, the storage means can be replaced with a new storage means storing information corresponding to the tilt of new line heads at the same time as the replacement of the cartridge.

Instead of supplying delay signals to the light emitting element lines in FIG. 22, the following simple control may be conducted. That is, delay control signal for correcting the tilt of the line head is inputted into the front light emitting element line (28*a*) as taken from the paper feeding direction in FIG. 21(A). On the other hand, the light emitting element lines (28*b*, 28*c*) including and after the second light emitting element line are controlled with signals formed by adding signal corresponding to the timing shift from the former light emitting element line to the aforementioned delay control signal for the front light emitting element line. According to this control method, the control for light emitting elements can be simplified as compared to the case in which delay timings are set for all of the light emitting element lines.

Figures 24C, 24K, 24M, 24Y:
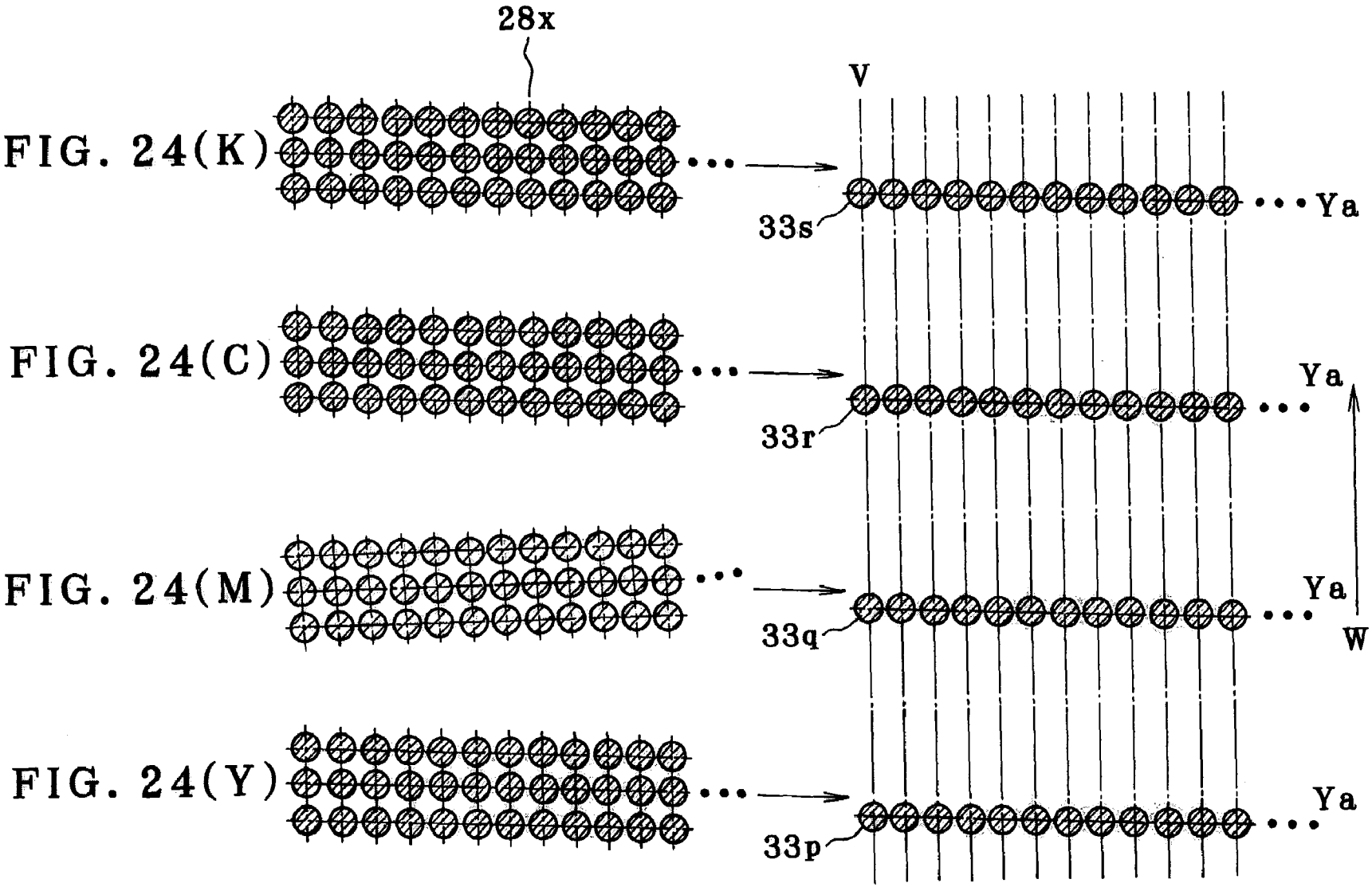
FIG. 24 is an explanatory illustration showing an example of image formation according to the present invention.

FIG. 24 is an explanatory illustration corresponding to FIG. 20. This example is an example of image formation with four colors. In the example shown in FIG. 24, a line head for magenta (M) is installed to the apparatus in a state tilted relative to the main scanning direction Ya. First, a pixel line 33*p* is formed on a paper sheet by a line head for yellow (Y). Then, the paper sheet is fed in the direction W and a pixel line 33*q* is formed to be superposed on the pixel line 33*p* on the paper sheet by the line head for magenta (M) In this case, as described with regard to FIG. 22, the misalignment in image due to the tilt of the line head for magenta (M) is corrected. Therefore, misalignment between the pixel line 33*p* and the pixel line 33*q* does not occur. Then, the paper sheet is fed in the direction W and a pixel line 33*r* is formed to be superposed on the pixel lines 33*p*, 33*q* by a line head for cyan (C). The paper sheet is further fed in the direction W and a pixel line 33*s* is formed to be superposed on the pixel lines 33*p*, 33*q*, 33*r* by a line head for black (K).

Though the line head for magenta (M) is installed to the apparatus in a state tilted relative to the main scanning direction Ya, the pixel line 33*q* formed by the line head for magenta (M) is parallel to the line of the main scanning direction Ya in the example of FIG. 24. Therefore, the misalignment from the other colors does not occur, thereby preventing the deterioration of printing quality.

Figure 25A:
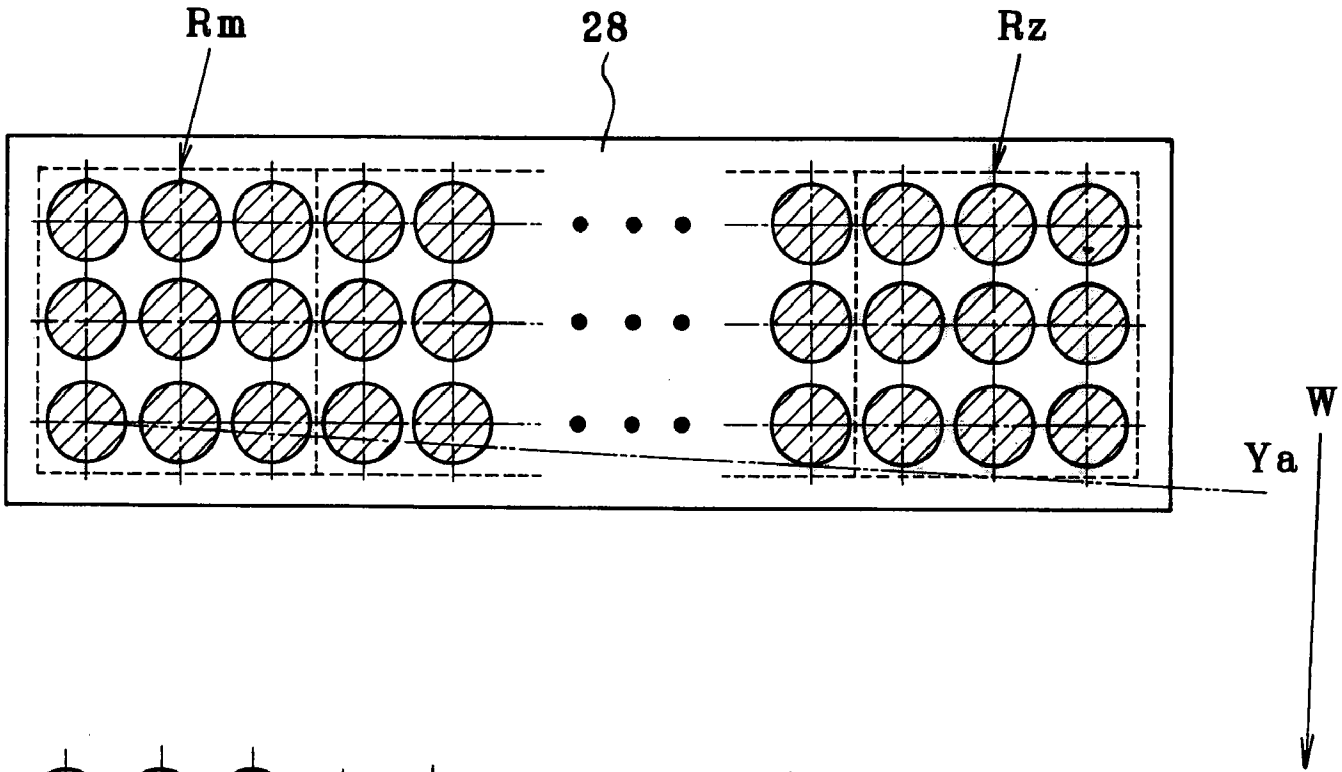
FIGS. 25(A), 25(B) are explanatory illustrations showing an example of image formation according to another embodiment of the present invention.
Figure 25B:
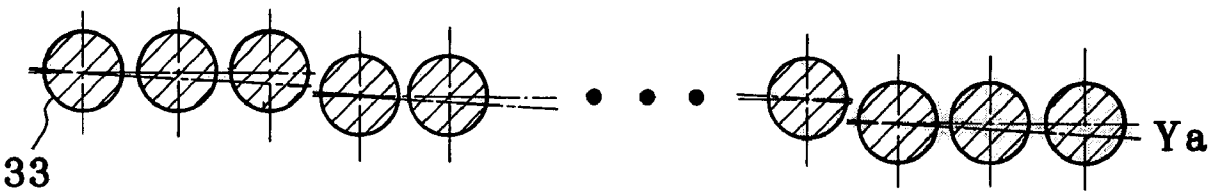

FIGS. 25(A), 25(B) are explanatory illustrations showing another embodiment according to the present invention. FIG. 25(A) shows a line head 28 and FIG. 25(B) shows a pixel line 33 of image formed by the line head 28 after correcting the tilt of the line head 28. In the example shown in FIG. 24(A), the line head 28 is installed to the apparatus in a state tilted relative to the main scanning direction Ya. In this example, blocks Rm–Rz including several light emitting element rows are formed.

In the example of FIG. 25(A), delay timing for light emitting elements is set for every block. In this case, the circuit structure of the control unit can be simplified as compared to the case in which delay timings are set for all of the light emitting element lines like the case shown in FIG. 21(A). As shown in FIG. 25(B), slight differences are created in the pixel line which is formed after the tilt of the line head is corrected. However, these differences are slight to cause no trouble in practice. Therefore, also in the example of FIG. 25(A), the deterioration of printing quality due to the tilt of line head can be reduced.

Figure 26:
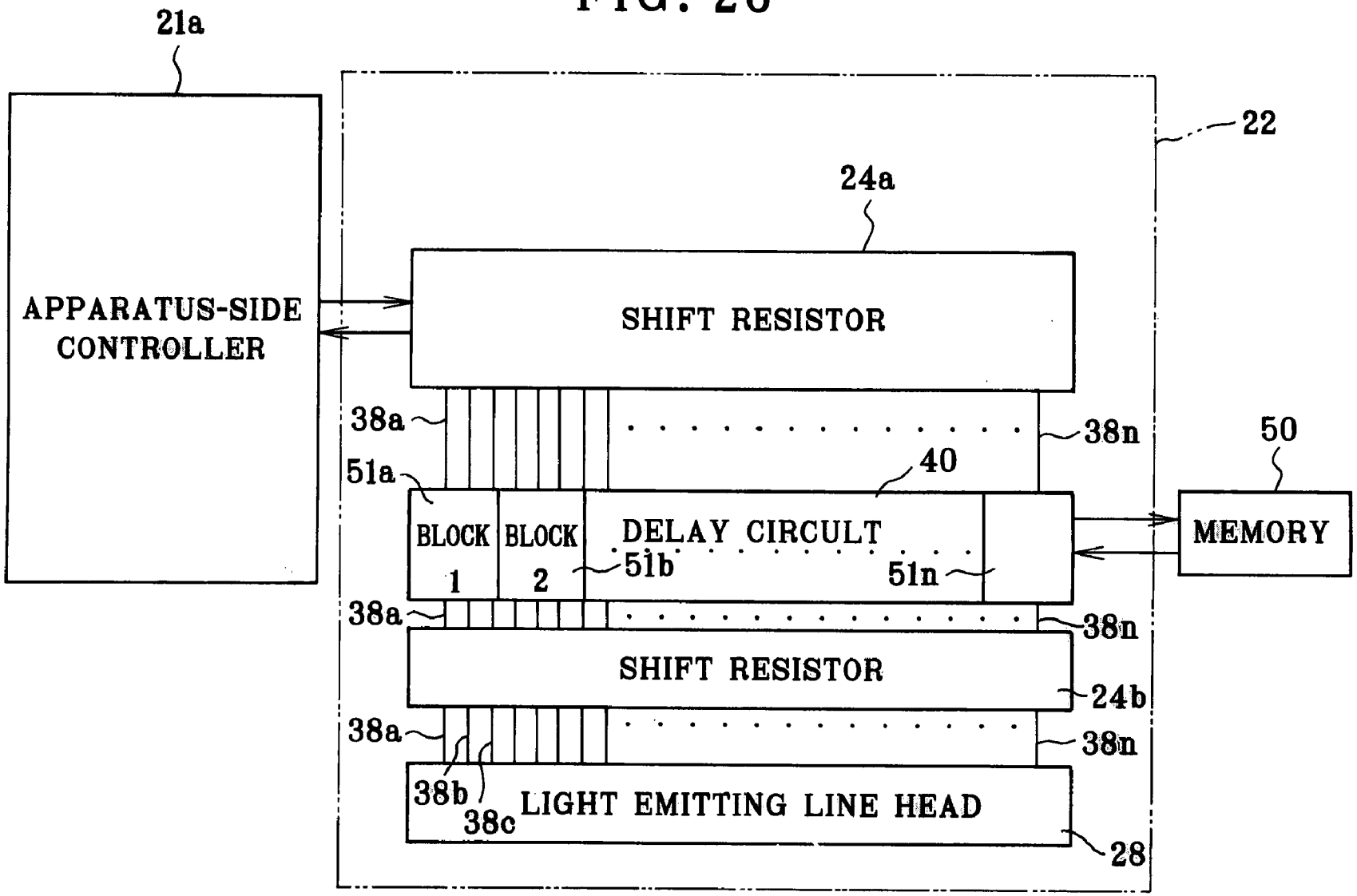
FIG. 26 is a block diagram showing a control unit corresponding to the example shown in FIG. 25.

FIG. 26 is a block diagram of a control unit corresponding to FIG. 25(A). The same parts as those used in FIG. 22 are marked with the same numerals so that detail description about such parts will be omitted. In FIG. 26, the delay circuit 40 is provided with control signal forming portions 51*a*–51*n* corresponding to the blocks of the light emitting element rows, respectively. Stored in the memory 50 is tilt information of the line head 28. For example, a signal from the control signal forming portion 51*a* of the delay circuit 40 is given to the light emitting element line head 28 through the second shift resistor 24*b* so as to operate light emitting elements. Signals passing through the signal lines 38*a*–38*c* are the same. In the example of FIG. 25(A), the light emitting elements in the light emitting element rows in the block Rm are operated with the same delay timing. Since delay control is conducted to the image data to be supplied to the light emitting elements for every block in the example of FIG. 26 as mentioned above, the circuit structure of this example can be simplified as compared to the case in which delay control is conducted for every light emitting element like the example of FIG. 22.

Figure 27:
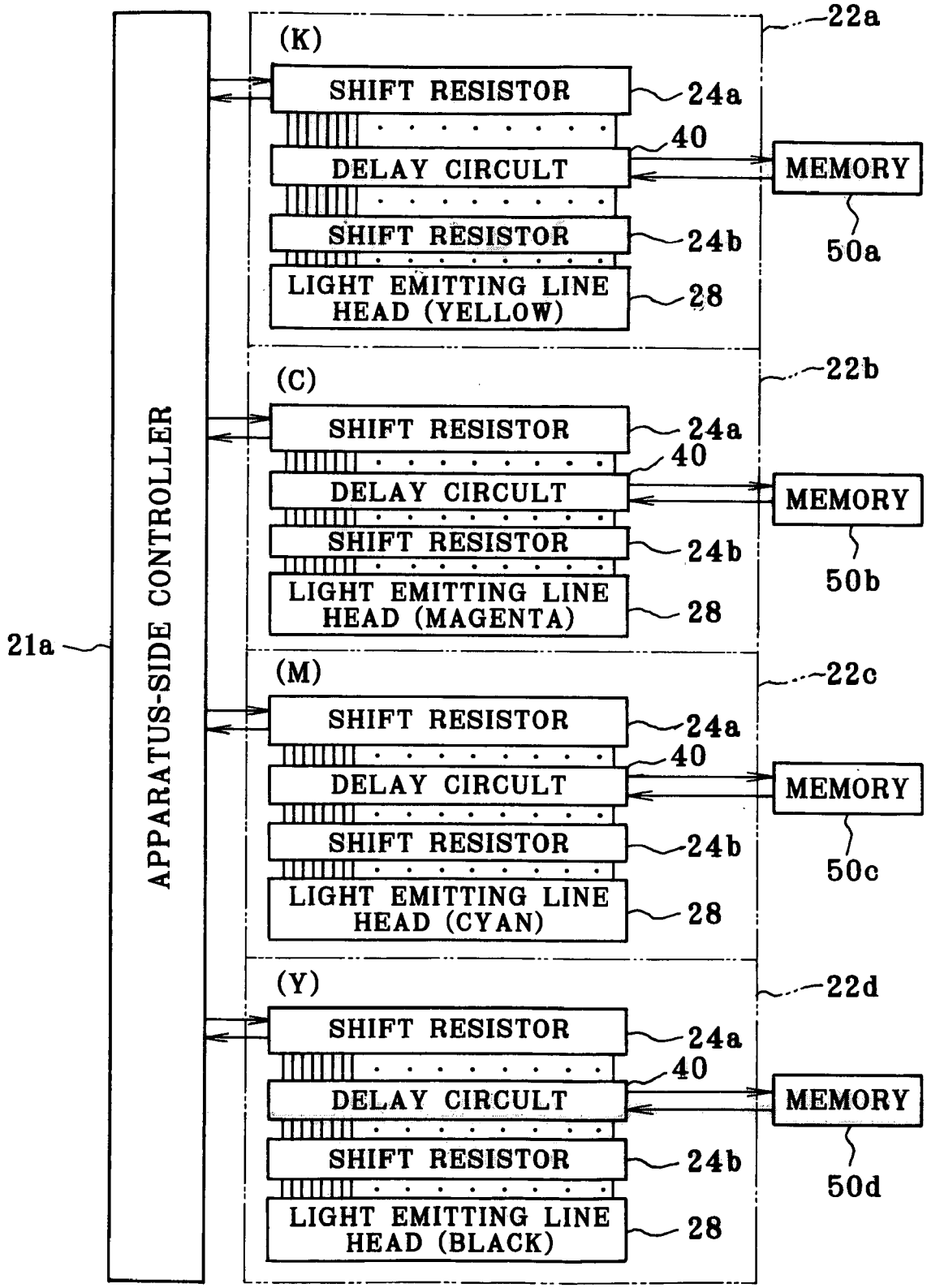
FIG. 27 is a block diagram showing control units according to an another embodiment of the present invention.

FIG. 27 is a block diagram showing another embodiment of the present invention. In the example of FIG. 27, control units are provided to correspond to line heads for four colors, i.e. black (K), cyan (C), magenta (M), yellow (Y), respectively. In FIG. 27, numeral 21*a* designates an apparatus-side controller corresponding to the respective line heads for four colors. Numeral 22*a* designates a control unit corresponding to the control units for the line head for black (K), 22*b* designates a control unit corresponding to the line head for cyan (C), 22*c* designates a control unit corresponding to the line head for magenta (M), and 22*d* designates a control unit corresponding to the line head for yellow (Y). In addition, memories 50*a*–50*d* are provided to correspond to the control units 22*a*–22*d*, respectively. According to the structure shown in FIG. 27, in a color printer having respective line heads for four colors as shown in FIG. 24, the control units can be adopted to control the light emitting element rows when one of the line heads is tilted. In addition, each of the delay circuits 40 of the control units 22*a*–22*d* may be structured to set a delay timing for every block like the example of FIG. 26.

Figure 28A:
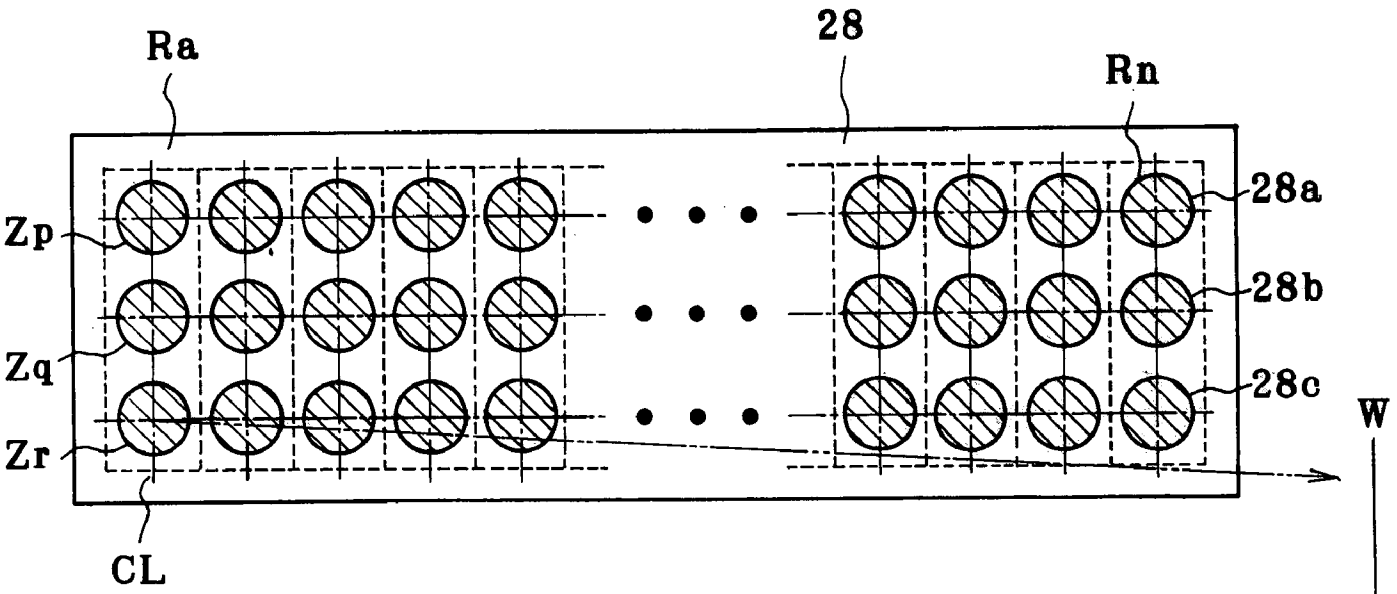
FIGS. 28(A), 28(B) are explanatory illustrations showing an example of image formation according to anther embodiment of the present invention.
Figure 28B:
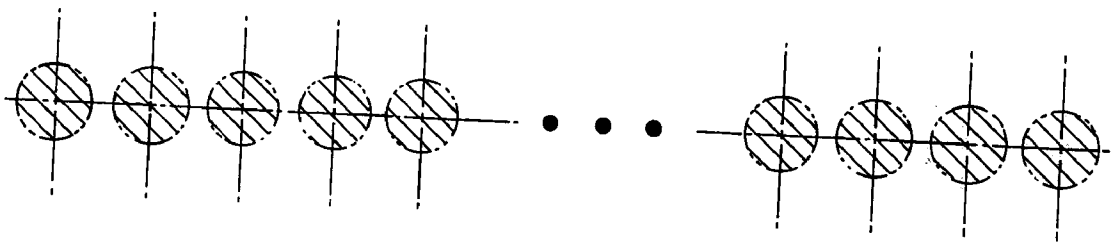

FIGS. 28(A), 28(B) are explanatory illustrations showing another embodiment according to the present invention. In the example shown in FIGS. 28(A), 28(B), the effect of the tilt of the line head 28 is corrected by changing the amounts of light of the light emitting element lines 28*a*–28*c*. That is, since the line head 28 is tilted relative to the main scanning direction Ya, the light emitting elements are shifted in the width direction among the light emitting element rows Ra–Rn. For example, in the light emitting element rows Ra, the light emitting element Zq of the light emitting element line 28*b* is defined as the reference. In this case, on the basis of the center line CL of the light emitting element Zq, the light emitting element Zp of the light emitting element line 28*a* protrudes to the left in the drawing. On the other hand, the light emitting element Zr of the light emitting element line 28*c* protrudes to the right in the drawing on the basis of the center line CL of the light emitting element Zq.

Accordingly, the light emitting element Zp and the light emitting element Zr protrude from the width of the exposure line. Therefore, the outlines of pixels which are adjacent to each other in the main scanning direction are superposed on each other, thus deteriorating the image quality as described with reference to FIG. 19. In the embodiments as described in the above to cope with this problem, the amounts of light of the light emitting elements are equal and the delay circuit(s) is used to delay the operation timings of light emitting elements for every light emitting element row or for every block including a plurality of light emitting rows.

Figure 23:
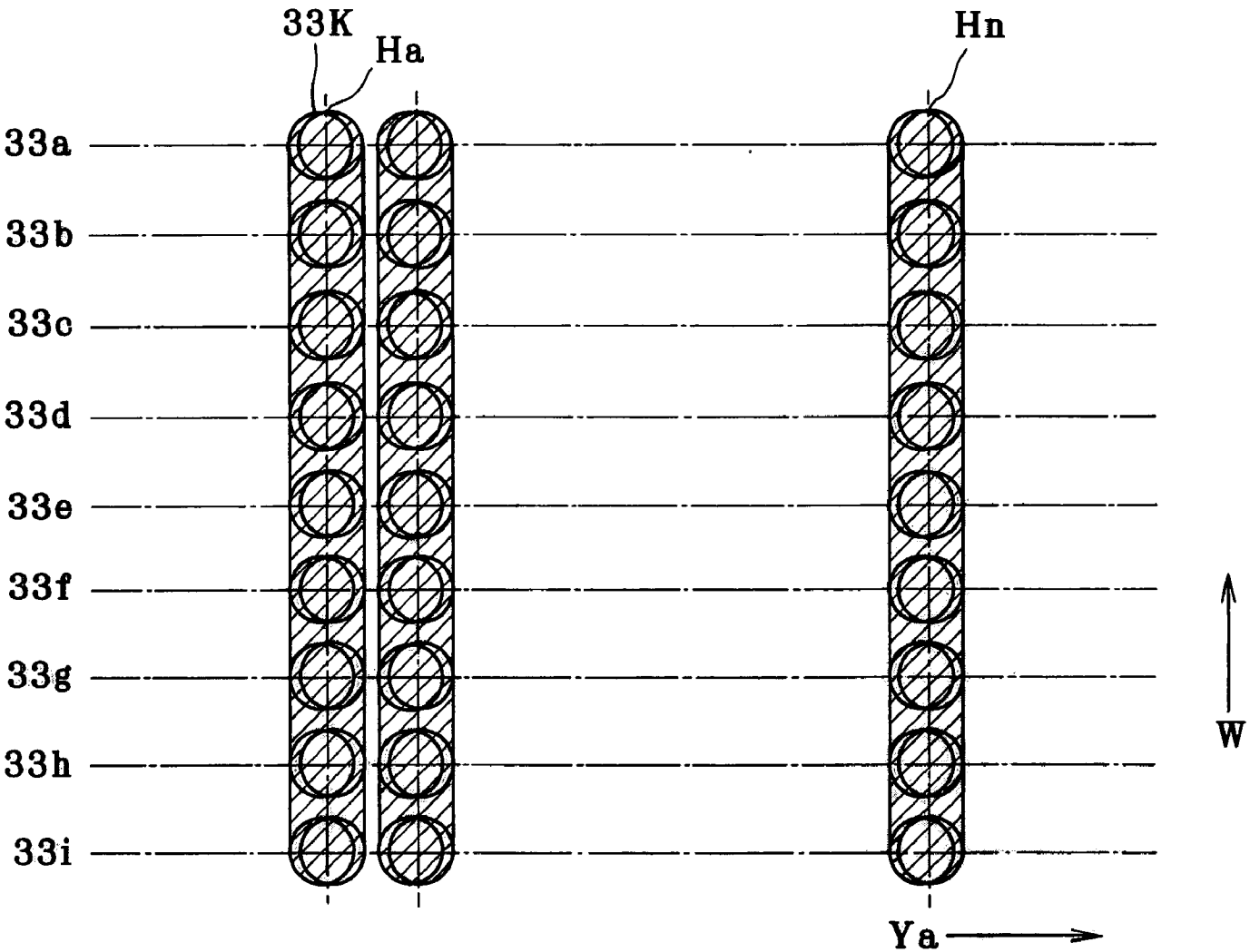
FIG. 23 is an explanatory illustration showing an example of image formation according to the present invention.

The example of FIGS. 28(A), 28(B) adjusts the amounts of light of light emitting elements in addition to the use of the delay circuit(s). That is, on the basis of the amount of light of each light emitting element on the light emitting element line 28*b*, the amount of light of each light emitting element on the light emitting element lines 28*a*, 28*c* above and below the light emitting element line 28*b* is reduced. Therefore, image to be formed by the light emitting elements protruding in the width direction of the exposure line is prevented to be formed, thereby preventing the outlines of pixels which are adjacent to each other in the main scanning direction from being superposed on each other as shown in FIG. 23 and therefore maintaining the printing quality well. FIG. 23 is an explanatory illustration corresponding to FIG. 19, but according to the embodiment of the present invention. The parts corresponding to the parts used in FIG. 19 are marked with the same numerals. FIG. 23 shows an example in which the outlines of pixels which are adjacent to each other in the main scanning direction are not superposed on each other.

Figure 29:
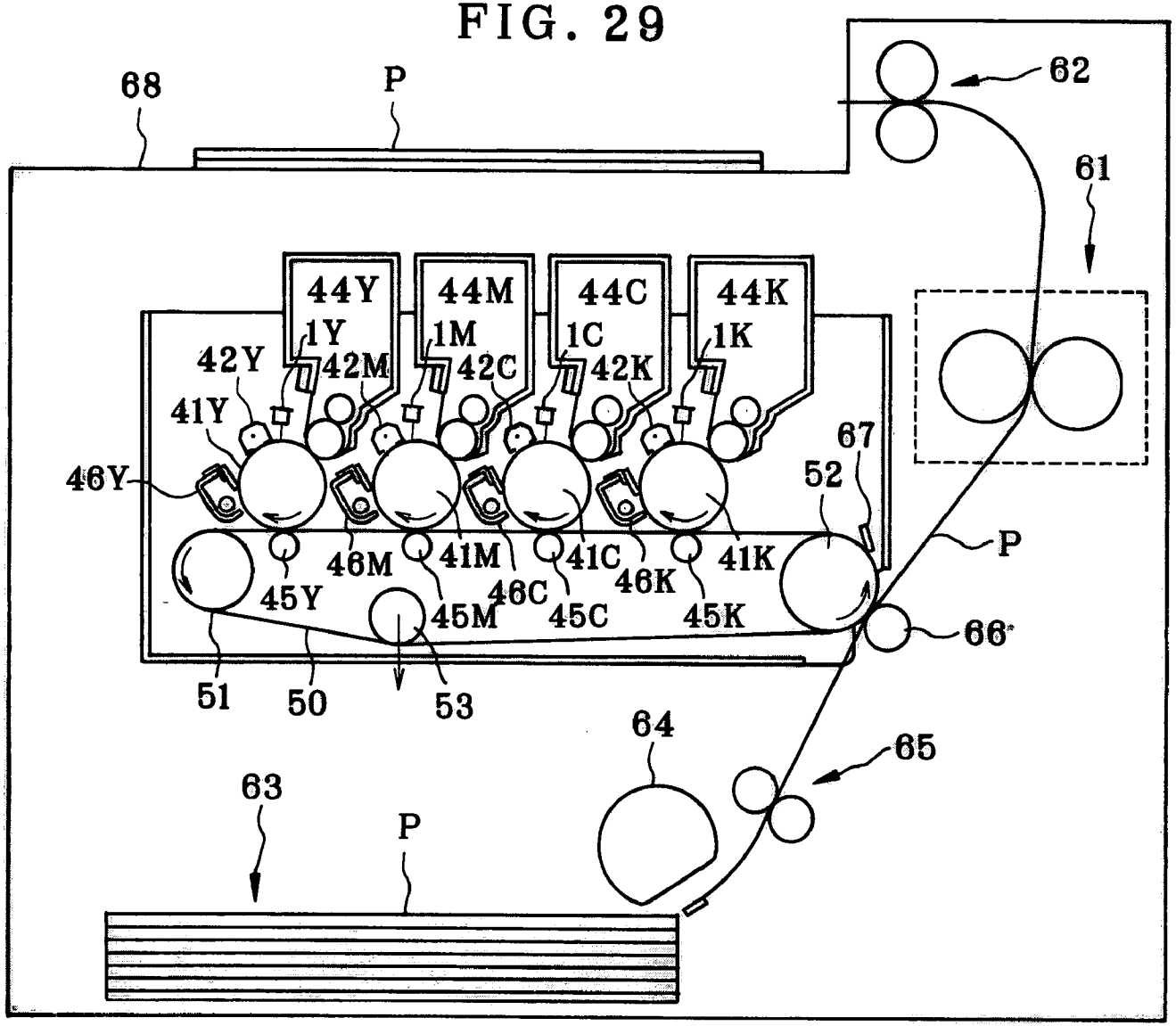
FIG. 29 is a front view showing the schematic structure of an image forming apparatus of a tandem type in which the organic EL array head of the present invention is arranged.

FIG. 29 is a front view showing an example of an image forming apparatus employing the organic EL array head described with reference to FIG. 12. The image forming apparatus is of a tandem type in which four similar organic EL array exposure heads 1K, 1C, 1M and 1Y are disposed at the respective exposure positions of four similar photoreceptor drums (image carriers) 41K, 41C, 41M and 41Y corresponding thereto. As shown in FIG. 29, the image forming apparatus has a driving roller 51, a driven roller 52, and a tension roller 53 and has an intermediate transfer belt 50. The intermediate transfer belt 50 is laid around the driving roller 51 and the driven roller 52 with a certain tension applied by the tension roller 53 and is driven to circulate in the direction of the arrows shown in FIG. 29 (counterclockwise direction) by the driving roller 51. Four photoreceptor drums 41K, 41C, 41M and 41Y are disposed at predetermined distance along the intermediate transfer belt 50. Each photoreceptor drum has a photosensitive layer on the outer peripheral surface thereof to serve as an image carrier.

Suffixes "K", "C", "M", and "Y" added to reference numerals indicate black, cyan, magenta, and yellow, respectively. That is, the photoreceptor drums designated by reference numerals with such suffixes are photoreceptor drums for black, cyan, magenta, and yellow, respectively. The same is true for other members. The photoreceptor drums 41K, 41C, 41M and 41Y are driven to rotate in the direction of arrows shown in FIG. 29 (clockwise direction) synchronously with the driving of the intermediate transfer belt 50. Arranged around each photoreceptor drum 41 (K, C, M, Y) are a charging means (corona charger) 42 (K, C, M, Y) for uniformly charging the outer peripheral surface of the photoreceptor drum 41 (K, C, M, Y), an organic EL array exposure head 1 (K, C, M, Y) having the aforementioned structure of the present invention for sequentially line-scanning the outer peripheral surface of the photoreceptor drum 41 (K, C, M, Y), which has been uniformly charged by the charging means 42 (K, C, M, Y), synchronously with the rotation of the photoreceptor 41 (K, C, M, Y).

Also arranged around each photoreceptor drum 41 (K, C, M, Y) are a developing device 44 (K, C, M, Y) for applying toner as a developer to an electrostatic latent image formed by the organic EL array exposure head 1 (K, C, M, Y) so as to form a visible image (toner image), a primary transfer roller 45 (K, C, M, Y) serving as transfer means for sequentially transferring the toner image developed by the developing device 44 (K, C, M, Y) onto the intermediate transfer belt 50 as a primary transfer target, and a cleaning device 46 (K, C, M, Y) as cleaning means for removing the toner remaining on the surface of the photoreceptor drum 41 (K, C, M, Y) after the transfer of the toner image. Each organic EL array exposure head 1 (K, C, M, Y) is installed in such a manner that the array direction of the organic EL array exposure head 1 (K, C, M, Y) is parallel to the bus-bar of the photoreceptor drum 41 (K, C, M, Y). The emission energy peak wavelength of each organic EL array exposure head 1 (K, C, M, Y) and the sensitivity peak wavelength of the photoreceptor drum 41 (K, C, M, Y) are set to be approximately coincident with each other.

The developing device 44 (K, C, M, Y) uses anon-magnetic single-component toner as a developer, for example. The single-component developer is conveyed to a development roller through a supply roller, for example, and the thickness of the developer layer adhering to the development roller surface is regulated with a regulating blade. The development roller is brought into contact with or pressed against the photoreceptor drum 41 (K, C, M, Y) to allow the developer to adhere to the surface of the photoreceptor drum 41 (K, C, M, Y) according to the electric potential level thereof, thereby developing the electrostatic latent image into a toner image. Toner images of black, cyan, magenta and yellow formed by unicolor toner image forming stations for the four colors are sequentially primarily transferred onto the intermediate transfer belt 50 by a primary transfer bias voltage applied to the respective primary transfer rollers 45 (K, C, M, and Y), and sequentially superimposed on each other on the intermediate transfer belt 50 to form a full-color toner image, which is then secondarily transferred onto a recording medium "P" such as a paper at a secondary transfer roller 66. The transferred full-color toner image is fixed on the recording medium "P" by passing between a pair of fixing rollers 61 as a fixing device. Then, the recording medium "P" is discharged through a pair of sheet delivery rollers 62 onto an outfeed tray 68 formed on the top of the apparatus body.

In FIG. 29, reference numeral 63 designates a sheet cassette in which a stack of a large number of recording media P is held, 64 designates a pickup roller for feeding the recording medium P from the sheet cassette 63 one by one, 65 designates a pair of gate rollers for regulating the timing at which each recording medium P is supplied to the secondary transfer portion at a secondary transfer roller 66, 66 designates the secondary transfer roller as a secondary transfer means for forming the secondary transfer portion together with the intermediate transfer belt 50, 67 designates a cleaning blade as cleaning means for removing the toner remaining on the surface of the intermediate transfer belt 50 after the secondary transfer. As mentioned above, since the organic EL array shown in FIG. 12 is used as the writing means in the image forming apparatus shown in FIG. 29, the apparatus can be manufactured to have smaller size than a case using laser scanning optical system as the writing means.

Though the image forming apparatus and the image forming method of the present invention have been described with reference to the embodiments disclosed herein, the present invention is not limited thereto and various modifications may be made therein.

INDUSTRIAL APPLICATION

The present invention as described in the above can provide an image forming apparatus and an image forming method, which are directed to simplify the circuit structure and to speed up the light emitting control during the exposure of pixels on an image carrier in multiple exposure manner capable of outputting gradation, at low cost.

What we claim is:

1. An image forming apparatus in which a plurality of lines each having a plurality of light emitting elements are arranged to have rows in a sub scanning direction of an image carrier so that light emitting elements are arranged in a matrix in a plane, wherein pixels on said image carrier are exposed by the light emitting elements aligned in one line and exposed again by the light emitting elements aligned in the next line after the movement of said image carrier, and in the same manner, said pixels are sequentially exposed by the light emitting elements on another line after the movement of said image carrier so as to achieve multiple exposure of the pixels, said image forming apparatus comprising:

control means by which said light emitting elements on respective lines for exposing same pixels are driven by a TFT so as to emit a same amount of light, so that the pixels can be exposed according to gradation output formed by said control means; and storage means for storing image data formed by said control means and outputting said image data to said light emitting elements, wherein said storage means is composed of multiple shift resistors which are arranged to correspond to the lines of the light emitting elements arranged in the sub scanning direction, respectively, and are designed to transport image data, hold the image data, and output the image data to the light emitting elements, wherein the image data supply to the shift resistor on a first line is transmitted in the main scanning direction and is also transmitted in the sub scanning direction to the shift resistor on a next line, and, in this manner, the image data is sequentially transmitted in the sub scanning direction to the shift resistors on the respective lines so that the image data is outputted to the light emitting elements on each of lines corresponding to the shift resistors, respectively.

2. An image forming apparatus as claimed in claim 1, wherein there are lines of pixels to be exposed and lines of pixels not to be exposed on said image carrier, the light emitting elements on the respective lines are arranged to correspond to the lines of pixels to be exposed, respectively, said storage means are arranged to correspond to both the lines of pixels to be exposed and the lines of pixels not to be exposed, respectively, and the storage means corresponding to the lines of pixels not to be exposed do not output said image data.

3. An image forming apparatus as claimed in claim 2, wherein the interval in the sub scanning direction between spot positions formed on the image carrier by said light emitting elements is an integral multiple of the pixel pitch in the sub scanning direction.

4. An image forming apparatus as claimed in any one of claims 1, 2 or 3, wherein said light emitting elements are controlled by a driving circuit according to an active matrix method.

5. An image forming apparatus as claimed in claim 4, wherein the amounts of light of said light emitting elements are controlled in a PWM method.

6. An image forming apparatus as claimed in claim 4, wherein the amounts of light of said light emitting elements are controlled in an intensity modulation method.

7. An image forming apparatus as claimed in any one of claims 1, 2 or 3, wherein each of said light emitting elements comprises an organic EL.

8. An image forming apparatus as claimed in any one of claims 1, 2 or 3, wherein the image forming apparatus is of a tandem type which comprises at least two image forming stations each having an image carrier and further having a charging means, an exposure head, a developing means, and a transfer means which are arranged around said image carrier and forms a color image by passing a transfer medium through the respective stations.

9. An image forming method using a plurality of lines each of which has a plurality of light emitting elements to be controlled by a TFT and which are arranged to have rows in the sub scanning direction of an image carrier and using multiple shift resistors which are adapted to transport image data formed by control means, hold the image data, and output the image data to the light emitting elements, which are arranged to correspond to the lines of the light emitting elements, respectively, said image forming method comprising:

supplying image data to the shift resistor on a first row and transmitting the image data in the main scanning direction, actuating the light emitting elements on a first line to expose pixels on the image carrier to light according to the image data outputted from the shift resistor of the first line, moving the image carrier for a pixel pitch, transmitting the image data from the shift resistor on the first row to the shift resistor on the next row in the sub scanning direction synchronously with the movement of the image carrier in timing, actuating the light emitting elements on a next line to emit a same amount of light as that of the light emitting elements on the former line to repeatedly expose said pixels, and sequentially transmitting the image data in the sub scanning direction at the shift resistors for the respective lines with moving of the image carrier for the pixel pitch, so that said pixels are subjected to multiple exposure by the light emitting elements on the respective lines.

10. An image forming method as claimed in claim 9, further comprising actuating the light emitting elements according to the gradation output formed by said control means to expose the pixels.

* * * * *